US009032578B1

(12) United States Patent
Feeny

(10) Patent No.: US 9,032,578 B1
(45) Date of Patent: May 19, 2015

(54) MOP DEVICE WITH SCRUBBING PAD CARRIER MEMBER

(71) Applicant: John Feeny, Farmington Hills, MI (US)

(72) Inventor: John Feeny, Farmington Hills, MI (US)

(73) Assignee: The Tuway American Group, Inc., Troy, MI (US)

( * ) Notice: Subject to any disclaimer, the term of this patent is extended or adjusted under 35 U.S.C. 154(b) by 0 days.

(21) Appl. No.: 14/166,805

(22) Filed: Jan. 28, 2014

Related U.S. Application Data

(63) Continuation-in-part of application No. 13/162,414, filed on Jun. 16, 2011, now Pat. No. 8,756,745.

(60) Provisional application No. 61/355,403, filed on Jun. 16, 2010.

(51) Int. Cl.
*A47L 13/12* (2006.01)
*A47L 13/24* (2006.01)
*A47L 13/46* (2006.01)

(52) U.S. Cl.
CPC *A47L 13/24* (2013.01); *A47L 13/46* (2013.01)

(58) Field of Classification Search
CPC ..... A47L 13/42; A47L 13/44; A47L 13/46; A47L 13/12
USPC ..... 15/146, 147.1, 115, 228, 229.1, 246, 15/106, 121, 114, 117
See application file for complete search history.

(56) References Cited

U.S. PATENT DOCUMENTS 2,782,441 A * 2/1957 Lipton ..... 15/229.3
3,605,161 A * 9/1971 Moss et al. ..... 15/150
7,124,464 B2 * 10/2006 Williams et al. ..... 15/115

* cited by examiner

*Primary Examiner* — Shay Karls
(74) *Attorney, Agent, or Firm* — Young Basile Hanlon & MacFarlane P.C.

(57) ABSTRACT

A mop device that includes a mop handle connection member. The mop handle connection member has a central body having a first end and an opposed second end with means for engaging a mop handle member associated with the first end of the central body and at least one jaw member associated with the second end of the central body. The mop handle connection member includes a jaw member that is configured to releasably connect with a mop strand bundle. The jaw member has a first end proximate to the central body an opposed second end distal to the first end and a central arm region contiguously located therebetween. The central arm region has a flange projecting outward from the central arm and at least one detent defined in the central arm in spaced relationship to the flange. The mop device also has at least one accessory member connected to the mop handle connection member. The accessory member includes a mop attachment region that has opposed first and second faces and at least one cleaning region that is connected to the attachment region. The mop attachment region has at least one aperture defined therein. The aperture is configured to receive the central arm of the jaw member therein such that the first face of the attachment region contacts the flange of the jaw member and the opposed face of the attachment region is engaged by the detent.

17 Claims, 25 Drawing Sheets

MOP DEVICE WITH SCRUBBING PAD CARRIER MEMBER

BACKGROUND

This application is a continuation-in-part of U.S. Ser. No. 13/162,414 filed Jun. 16, 2011, the specification of which is incorporated in its entirety herein. U.S. Ser. No. 13/162,414 is a utility application claiming priority to U.S. Ser. No. 61/355,403 filed Jun. 16, 2010, the specification of which is also incorporated in its entirety herein.

The present invention pertains to mops. More particularly, the present invention pertains to mops augmented with tools and accessories.

The need for mops with enhanced scrubbing surfaces for certain cleaning applications has been recognized and addressed in various situations. This has resulting in the development of many mop accessories. One such device is discussed in U.S. Pat. No. 7,124,464 to Williams et al. While this device has merit, use of the device has been limited, due in part to the difficulty of effective integration of the device into the associated mop unit to provide an integrated surface scrubbing and cleaning tool.

Thus it would be desirable to provide a mop device with a surface scrubbing positively and effectively integrated therewith. It is also desirable to provide a scrubbing apparatus that can be effectively integrated with a mop unit to enhance surface scrubbing action.

SUMMARY

A mop device that includes a mop handle connection member. The mop handle connection member has a central body having a first end and an opposed second end with means for engaging a mop handle member associated with the first end of the central body and at least one jaw member associated with the second end of the central body. The mop handle connection member includes a jaw member that is configured to releasably connect with a mop strand bundle. The jaw member has a first end proximate to the central body an opposed second end distal to the first end and a central arm region contiguously located therebetween. The central arm region has a flange projecting outward from the central arm and at least one detent defined in the central arm in spaced relationship to the flange. The mop device also has at least one accessory member connected to the mop handle connection member. The accessory member includes a mop attachment region that has opposed first and second faces and at least one cleaning region that is connected to the attachment region. The mop attachment region has at least one aperture defined therein. The aperture is configured to receive the central arm of the jaw member therein such that the first face of the attachment region contacts the flange of the jaw member and the opposed face of the attachment region is engaged by the detent.

DESCRIPTION OF THE DRAWING

In order to better understand the invention disclosed herein, reference is made to the following drawing figures in which.

DETAILED DESCRIPTION

Disclosed herein is mop device 10 that can include one or more mop accessories in operative position relative to a suitable mop head member. The mop device 10 can include a mop handle connection member 12 that is configured to engage a suitable end of a mop handle member 14 in either a fixed or releasably connected manner to the mop handle member 14 and can be suitably configured to accomplish such attachment.

Figure 1:
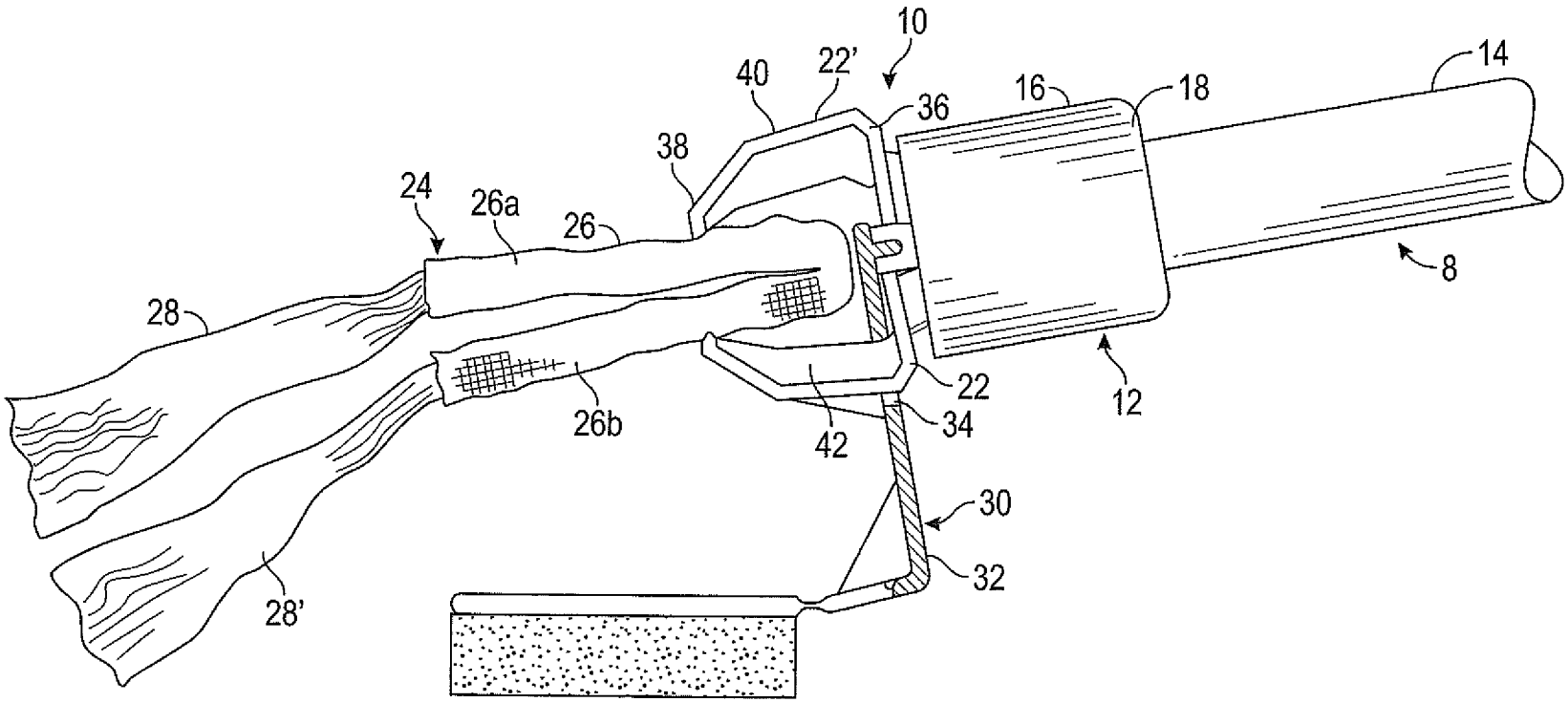
FIG. 1 is a partial cross sectional view of an embodiment of the invention disclosed herein.

The mop handle connection member 12 in the embodiment depicted in the FIG. 1 can be a central body shaft 16 having a first end 18 and an opposed second end 20. At least one jaw member 22 extends outwardly from the opposed second end 20 of the mop handle connection member 12. The jaw member 22 can be in either fixed or pivotal relationship relative to the mop handle connection member 12. The jaw member 22 can be configured to clampingly engage a mop head such as mop strand bundle 24 in fixed relationship when interposed between a suitable mating member to the jaw member 22. The suitable mating member may be a mating jaw member such as jaw member 22'. It is contemplated that one or both jaw members 22, 22' can be pivotally mounted relative to the mop handle connection member 12. The mop handle connection member 12 can include suitable means for releasably maintaining the jaw members 22, 22' in fixed clamped relationship with one another. In various embodiments, this can be achieved by suitable telescopic engagement with the respective jaw members 22, 22'.

The mop strand bundle 24 can have any suitable configuration. In the embodiment depicted in FIG. 1, the mop strand bundle 24 has a headband 26 centrally positioned, surrounding and attached to a plurality of yarn strand 28, 28'. In the embodiment depicted, the headband 26 is doubled over itself to provide two layers 26*a* and 26*b* in overlying relation to one another. The layers 26*a* and 26*b* are held in fixed clamped relationship to one another by the action of jaw members 22, 22' such that strands of essentially equal length project outwardly therefrom. Other configurations of mop strand bundles are also contemplated. Non-limiting examples of other mop strand bundle 24 configurations include the mop strand bundle 24 configuration disclosed in Ser. No. 13/162, 414 filed Jun. 16, 2011, the specification of which is incorporated herein by reference.

A suitable mop appliance 30 is connected to the jaw member 22 at an orientation that will engage the floor or other surface. The mop appliance 30 includes at least one engagement member and at least one appliance member connected to the engagement member. The appliance member can be any suitable cleaning tool or cleaning tool mounting device. The interface between the jaw member 22 and the mop appliance 30 includes and makes use of at least one aperture 34 defined in the body 32 of the suitable mop appliance 30. The jaw member 22 is configured to engage the aperture 34 in a fixed manner or releasably fixed manner.

As broadly disclosed herein, the jaw member 22 has a first end region 36 proximate to the central body, an opposed second end region 38 distal to the first end region 36 and a central arm region 37 contiguously located therebetween. The opposed second end region 38 is configured with gripping members such as teeth 40. In the various embodiments depicted in the various drawing figures, the teeth 40 are in spaced relationship along the outer or leading edge of the second end region 38. The gripping members are configured to engage the headband region of the associated mop strand bundle 24. Where the gripping member is configured as teeth 40, the teeth 40 can be configured to extend into the woven web of the headband 26 region 26*a* or 26*b* proximate to the gripping region.

The central region 37 of the jaw member 22 can be configured as an arcuate body having an outwardly oriented surface 41 and an opposed inwardly oriented surface 43. If desired or required, the jaw member 22 can include one or more ribs 42 that can project from the inwardly oriented surface 43. The ribs 42 can function as reinforcing members and can extend generally from the first end region 36 to the second end region 38 if desired or required.

Figure 3:
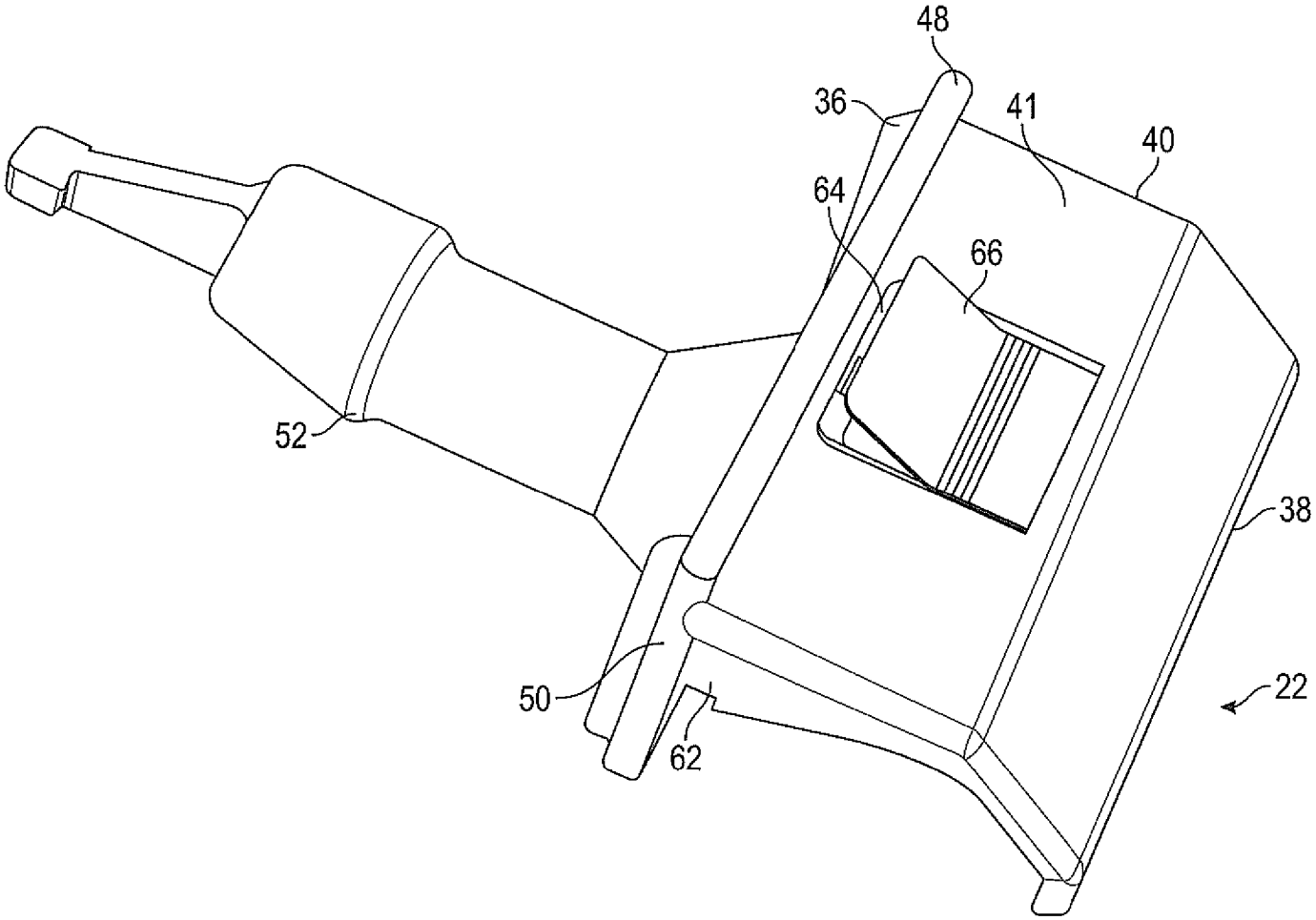
FIG. 3 is a perspective view of an embodiment of a jaw member employed in the device as disclosed herein.
Figure 7A:
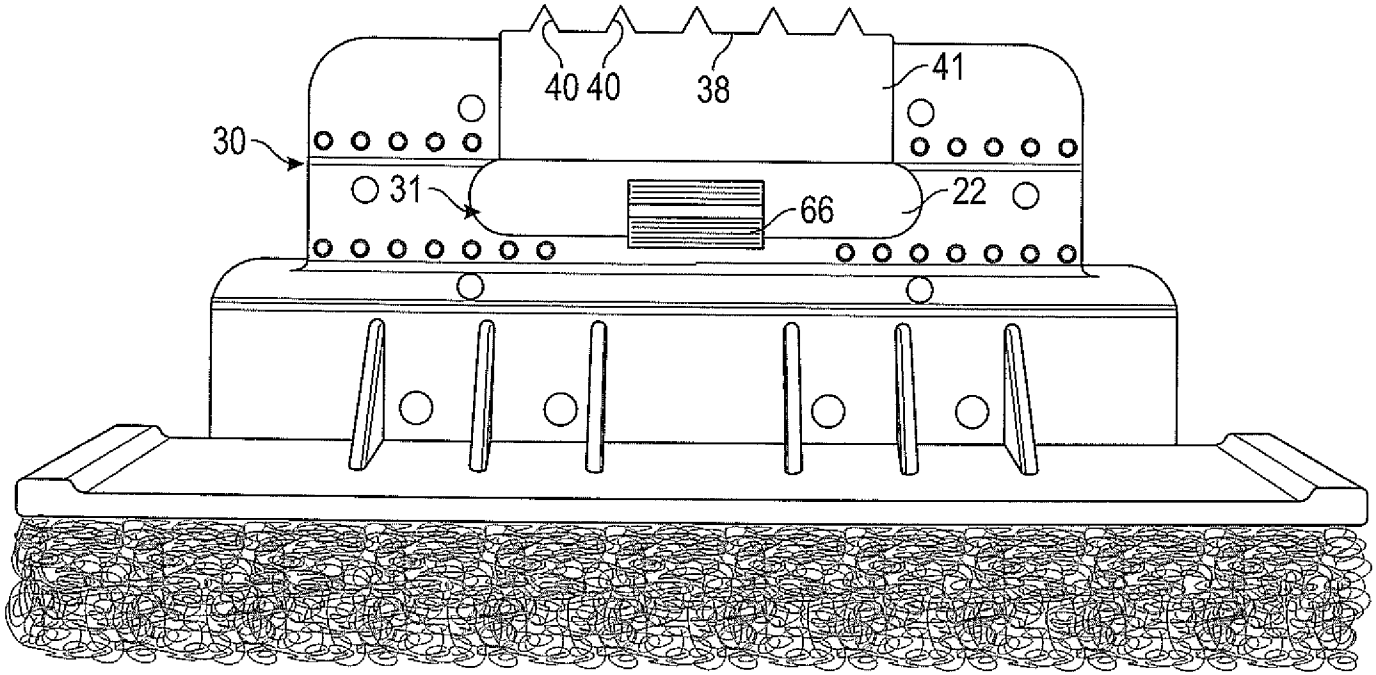
FIG. 7A is a frontal view of the embodiment of the jaw member of FIG. 3 in engagement with an embodiment of a mop accessory tool as disclosed herein.
Figure 7B:
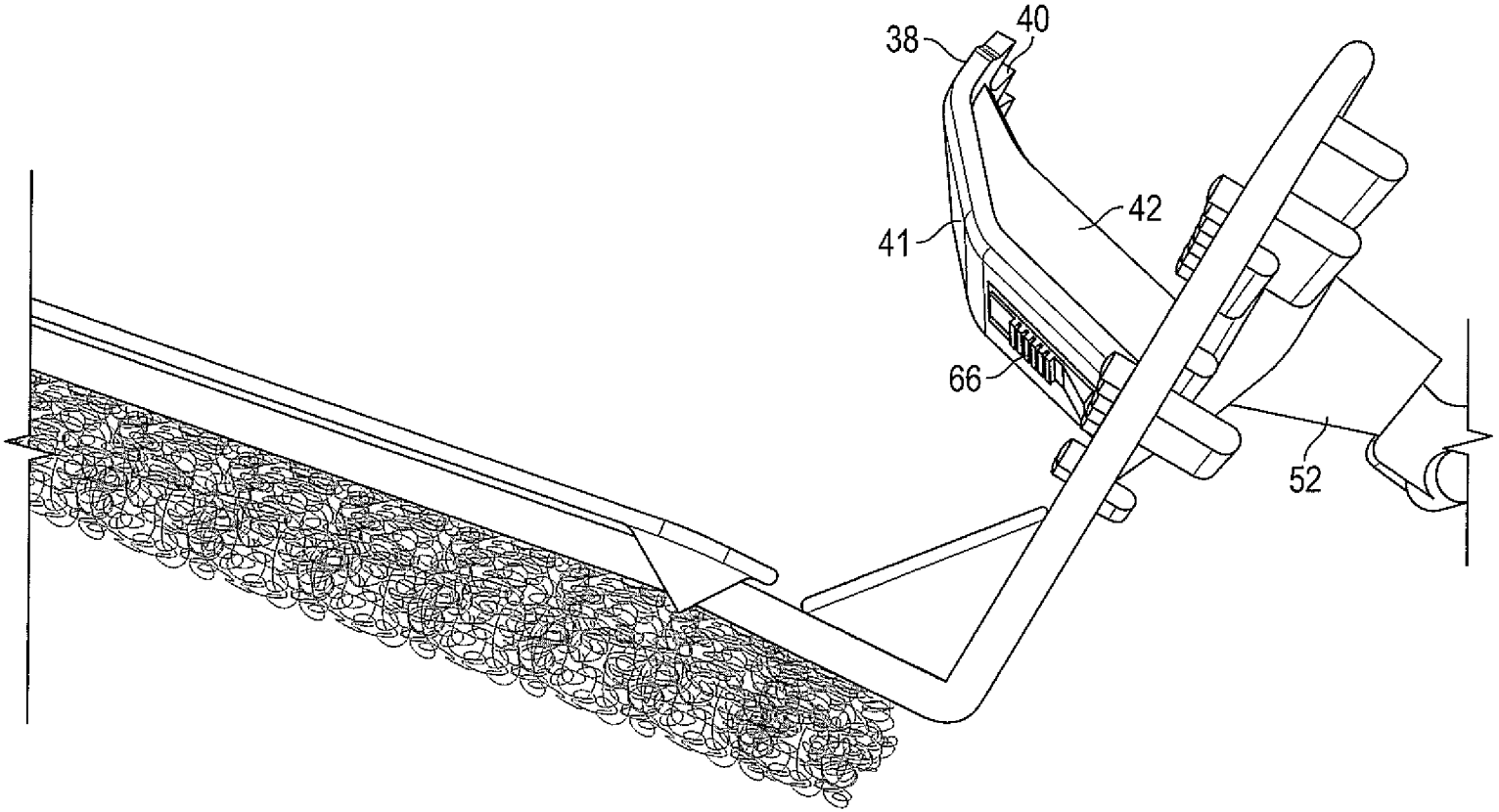
FIG. 7B is a side view of the assembly of FIG. 7A.
Figure 8A:
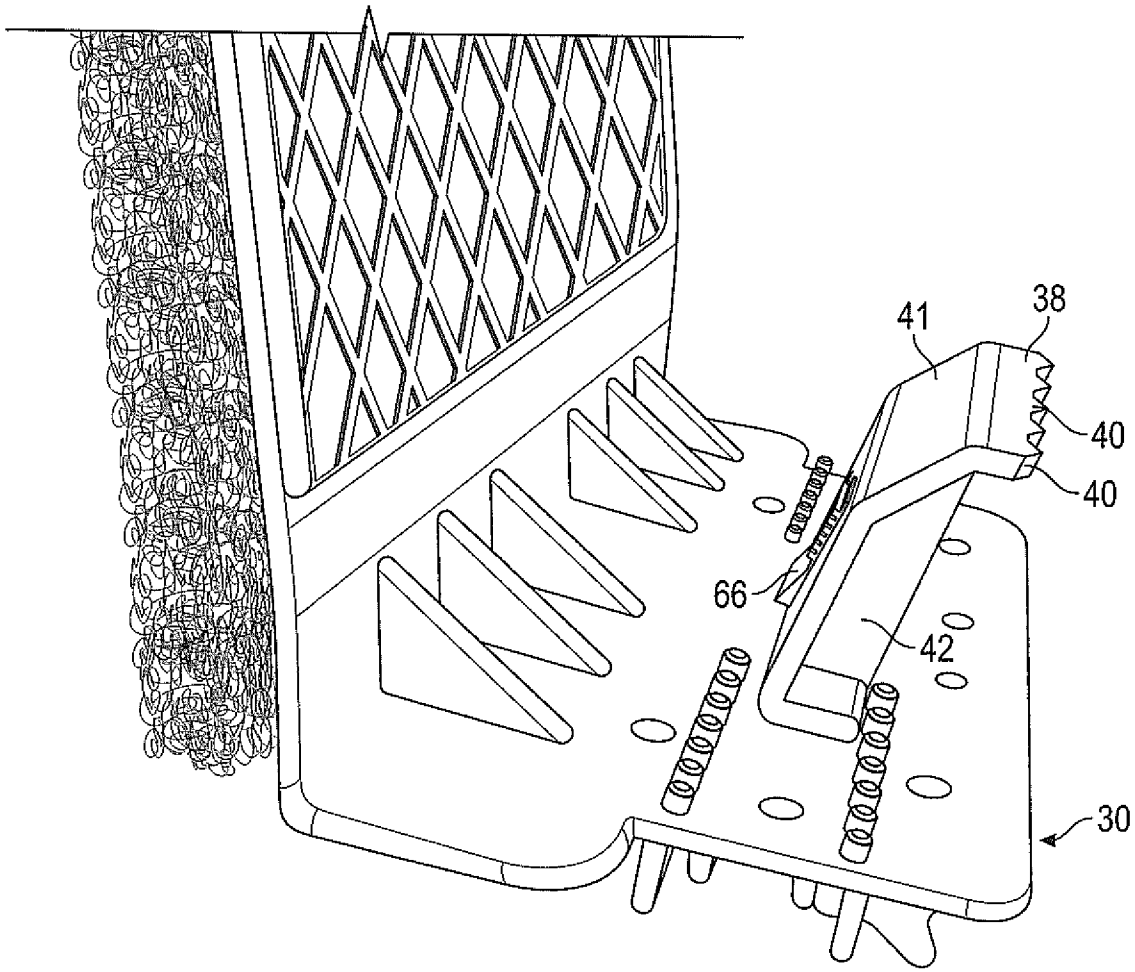
FIG. 8A is a detail view of the embodiment of the engagement portion of an embodiment of the jaw member of FIG. 3 in engagement with an embodiment of a mop accessory tool as disclosed herein.
Figure 8B:
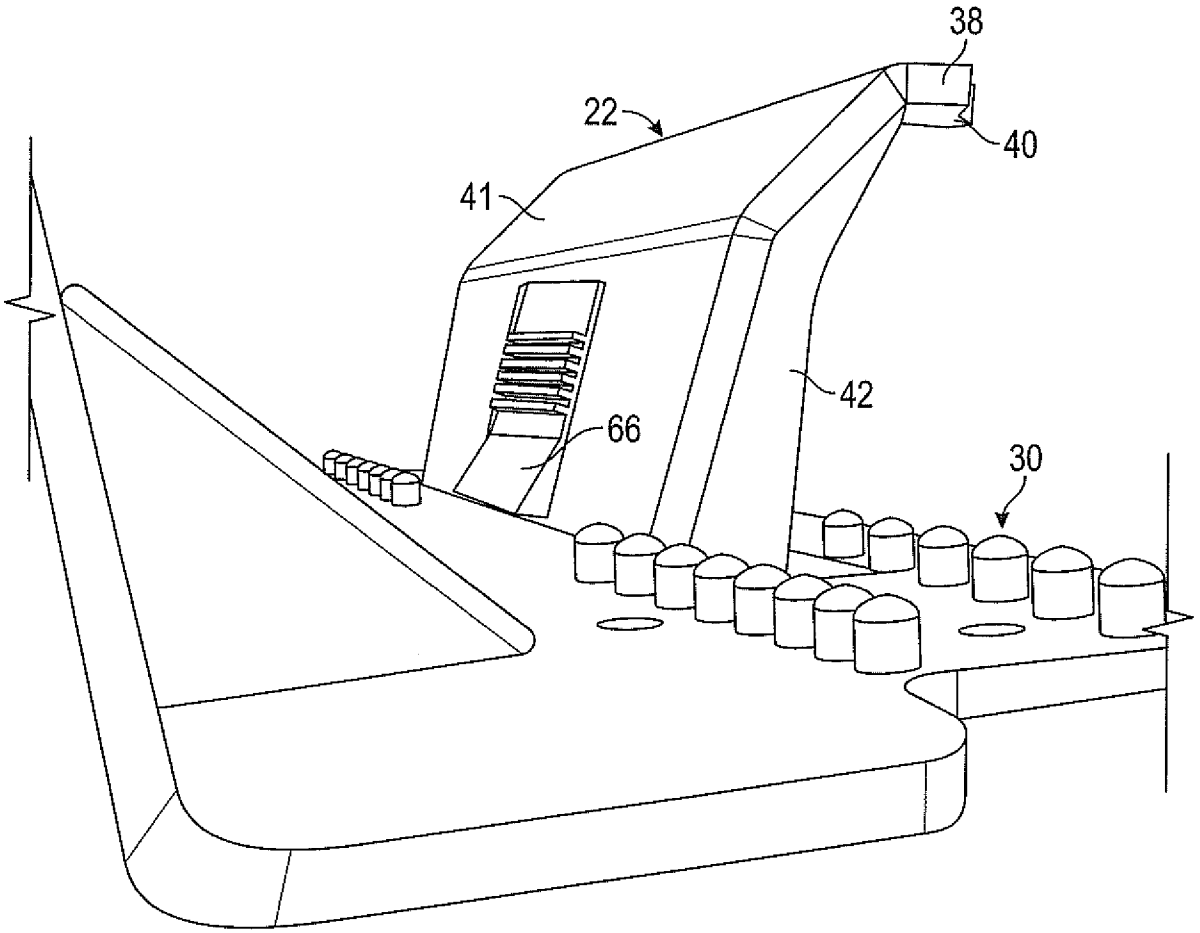
FIG. 8B is a detail perspective of the embodiment of the jaw member and assembly of FIG. 8A.
Figure 9:
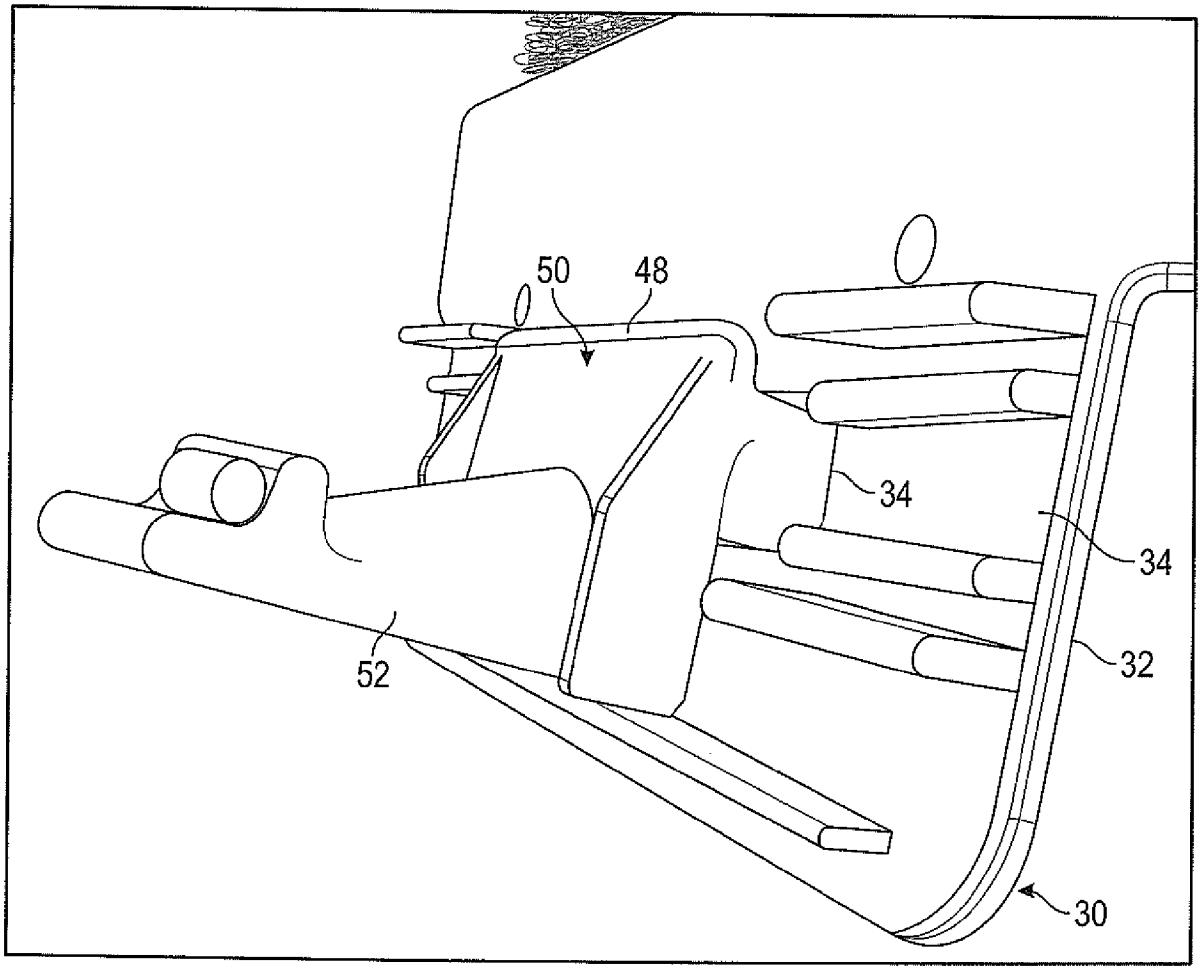
FIG. 9 is a detail perspective of an embodiment of the pivot end the jaw member of FIG. 3 in engagement with an embodiment of a mop accessory tool.

The first end region 36 of the jaw 22 can be configured with an anchoring stop such as a flange 48. As seen in FIGS. 3, 7A and 7B, flange 48 is oriented essentially perpendicularly to the ribs 42 and projects outward from the outwardly oriented surface 41 of the jaw member 22 to a spaced distance. The flange 48 extends for at least a part of the side-to-side distance of the jaw member 22. In the embodiment depicted in various drawing figures such as FIG. 3, the flange 48 extends from side to opposed side and is contiguous to and defines a wall member 50 associated with the first end region 36 of the jaw member 22. Flange 48 can be oriented contiguous to a wall member 50 as depicted in FIGS. 3 and 7.

It is also within the purview of this disclosure that the jaw member 22 be configured with a wall member 50 that forms a continuous surface with the outwardly oriented surface 41 as illustrated in FIG. 1. The jaw member 22 can be connected to the mop handle connection member 12 by any suitable configuration. In the embodiment depicted in FIG. 3, an arm 52 projects outwardly from the wall member 50. Arm 52 is configured to be suitably received in the mop handle connection member 12 in the manner described previously.

Figure 10:
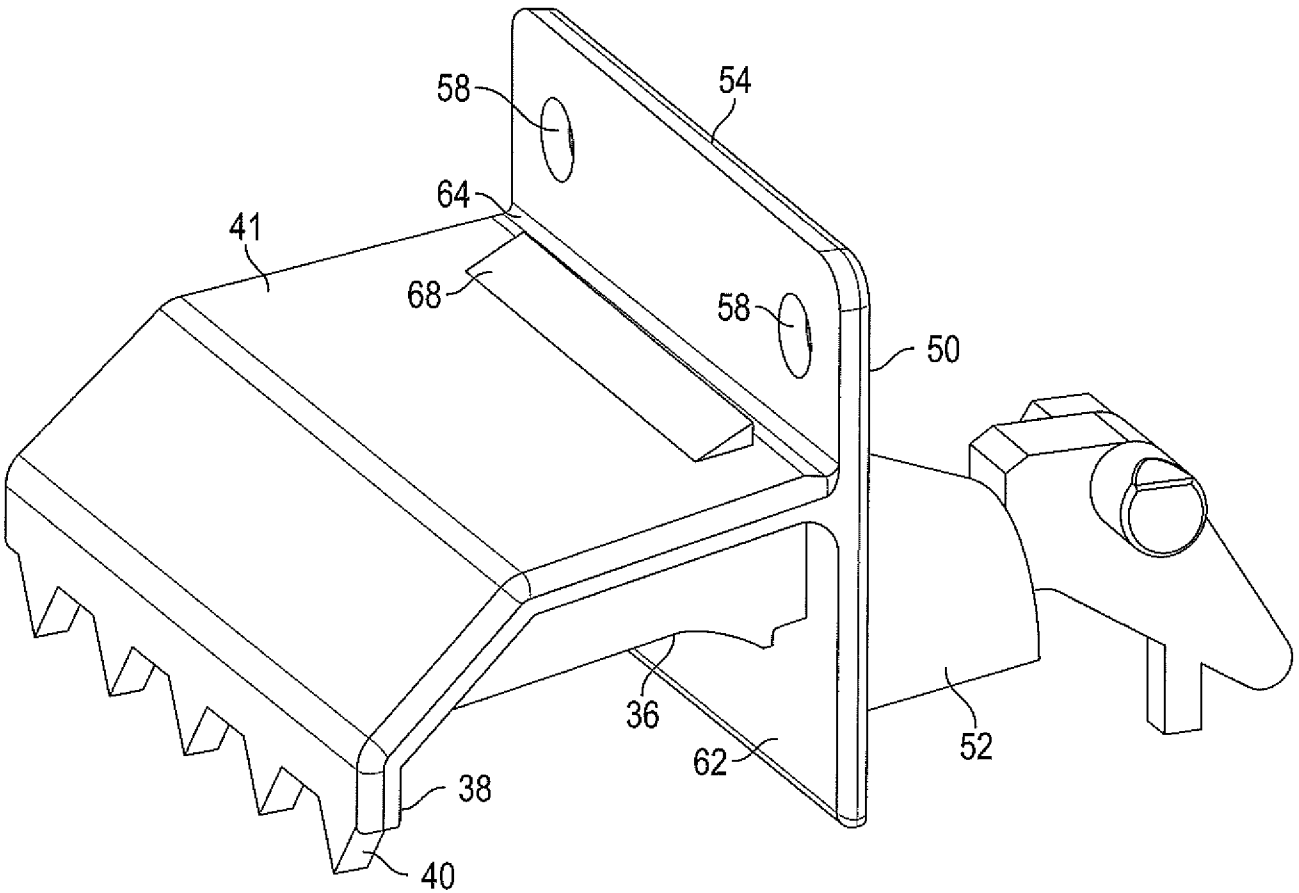
FIG. 10 is an upper perspective view of a first alternate embodiment of a jaw member as disclosed herein.
Figure 11:
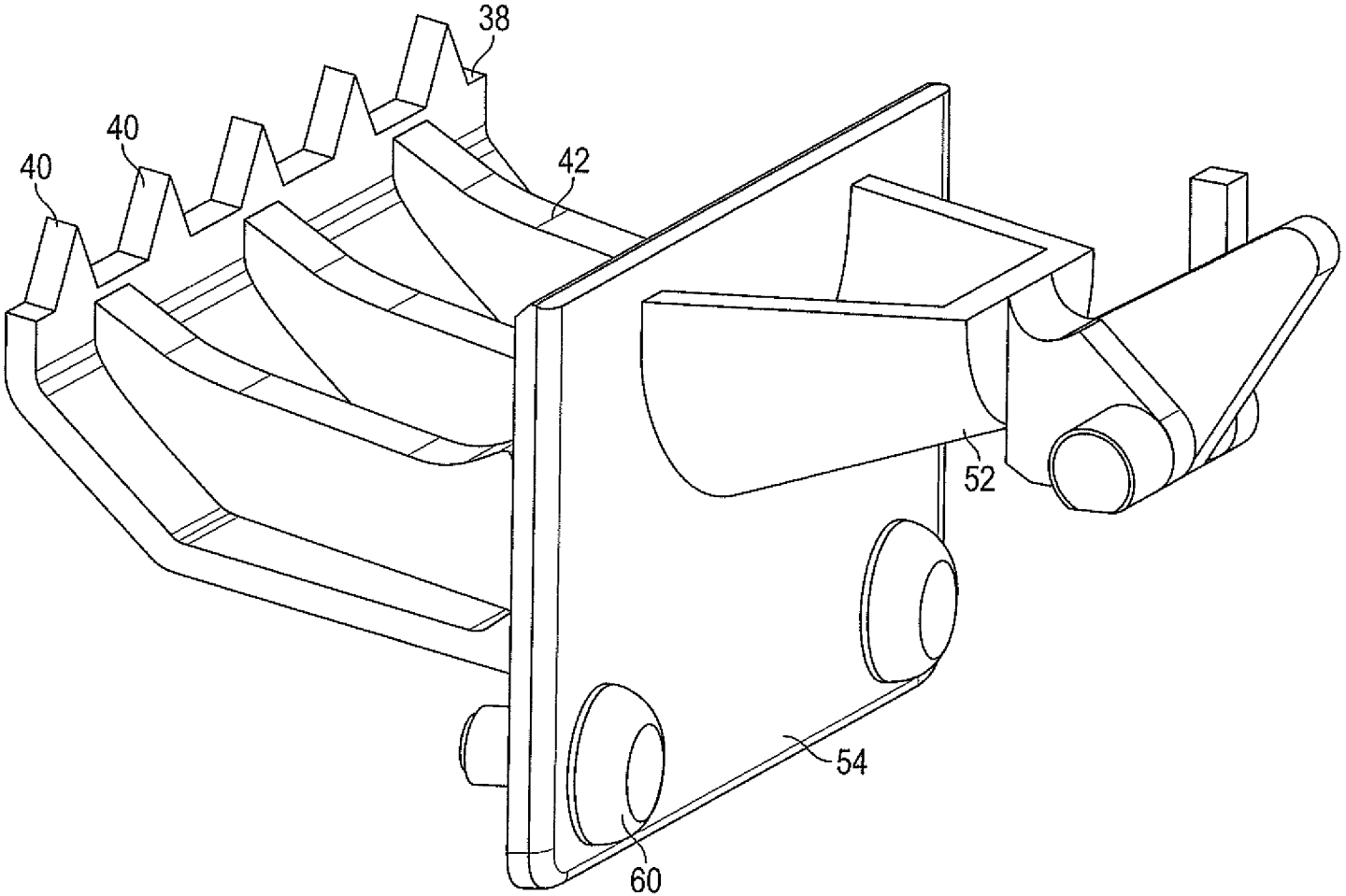
FIG. 11 is a lower perspective view of an the jaw member of FIG. 10.
Figure 12:
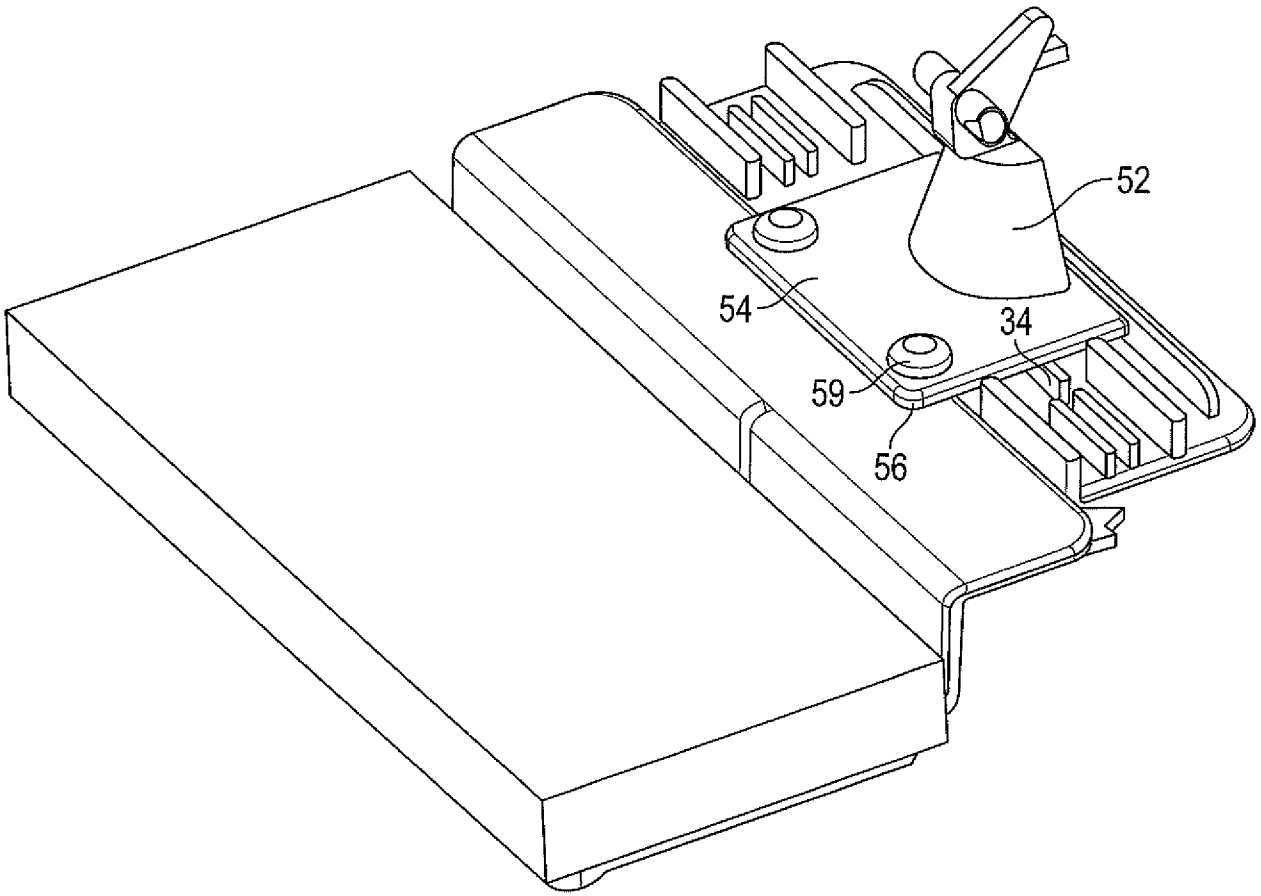
FIG. 12 is a perspective view of an embodiment of an embodiment of a fastening mechanism for a jaw member and mop accessory tool.

It is also within the purview of this disclosure to configure the wall member 50 with a projecting apron 54 that extends outward from the outwardly oriented surface 41. The projecting apron is configured and oriented to be in in overlying contact with a compatible planar section 56 of the mop appliance 30. In various embodiments, the planar section 56 of the mop appliance 30 is generally contiguous to the aperture 34. The projecting apron 54 can have suitable attachment regions defined therein. In the embodiment depicted in FIG. 10, the projecting apron 54 is configured with at least one aperture 58 configured to receive a suitable fastener 59 (seen in FIGS. 11 and 12) to connect the mop appliance 30 to the associated jaw member 22.

Figure 4:
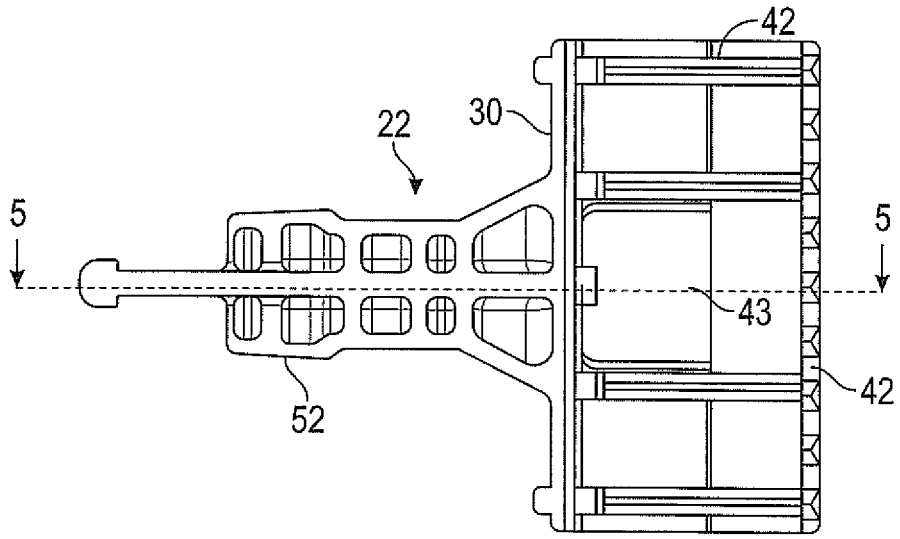
FIG. 4 is an interior side view of the jaw member of FIG. 3.
Figure 5:
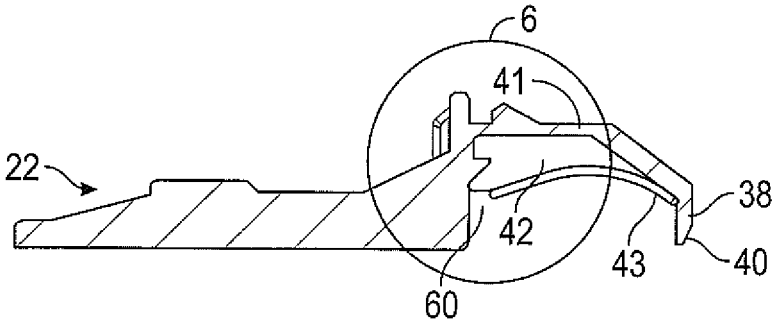
FIG. 5 is a cross sectional view of the jaw member taken through the 5-5 line in FIG. 4.
Figure 6:
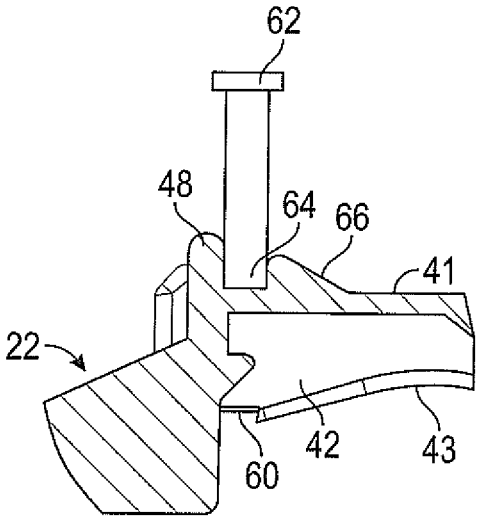
FIG. 6 is detail view of FIG. 5.

In the use position, the jaw member 22 is configured to engage the aperture defined in the mop appliance 30 as by as suitable aperture engagement means. In various embodiments disclosed herein, the jaw member 22 is configured to be telescopically received within the aperture 34 defined in the mop appliance 30 such that the two elements are in fixed relationship to one another. The engagement means can be configured such that the inwardly oriented surface 43 of jaw member 22 includes at least one retention member 60 configured to engage the proximate surface of aperture 34. (See FIGS. 4 and 5). In the embodiment depicted in FIGS. 4 and 5 the retention member 60 is a detent that is defined in the inner face 43 proximate to the first end region 36. In the embodiment depicted, the detent is defined on one or more ribs 42.

The aperture engagement means of jaw member 22 can include a flexible engagement region 62 defined in the outwardly oriented face 41 of the jaw member 22. The flexible engagement region 62 can include at least one detent 64 located proximate to the first end region 36. In the embodiment depicted in FIG. 3, the 64 detent is located proximate to the flange 48 and is defined by living hinge member 66 defined in the central region 40 of the jaw member 22. In the embodiment depicted in FIG. 10, the detent 64 is defined by fixed shoulder 68.

In the use position, the jaw member 22 engages the aperture 34 defined in the mop appliance such that opposed faces of the body 32 of the mop appliance 30 proximate to the aperture 34 are in engaged contact with the associated regions of the jaw member 22. In embodiments having detent 64 associated with a living hinge member 66, the living hinge member 66 baisingly urges the mop appliance 30 into contact with the associated jaw member 22. Positioning the mop appliance 30 relative to the jaw member 22 can be accomplished by depression of the living hinge member 66 together with insertion of the jaw member 22 into the aperture 34. Removal of the jaw member 22 can be accomplished by reverse action. In embodiments employing a fixed shoulder 68, insertion of the jaw member 22 into the associated aperture can be accomplished based on mutual elastic deflection of the respective members relative to each other.

Figure 2:
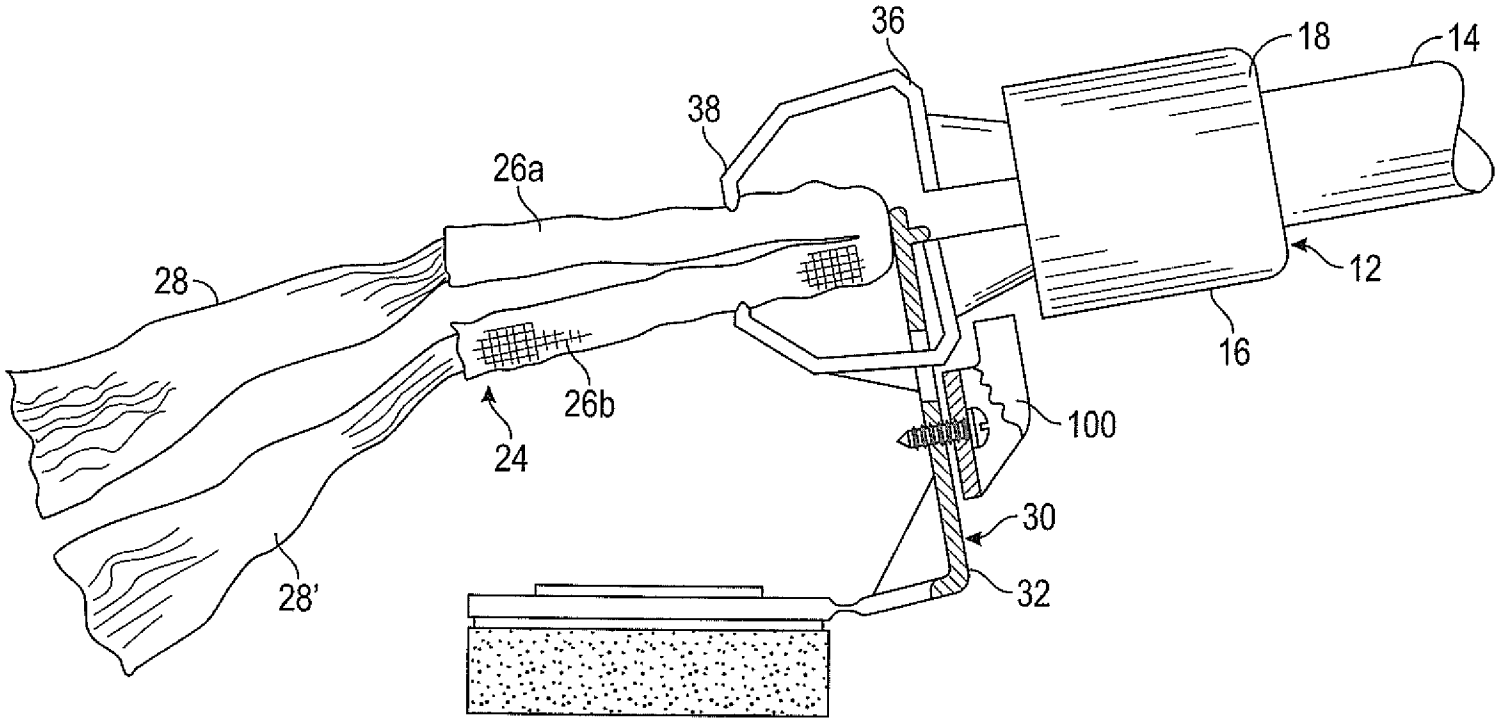
FIG. 2 is a partial cross sectional view of an alternate embodiment of the invention as disclosed herein.

The mop device 10 as disclosed herein can also include suitable attachment members the can include, but are not limited to, fasteners such as fastener 59 configured to directly connect the mop appliance 30 to the jaw member 22 or fastening block 100 configured to contact the jaw member 22 at a location on the outwardly oriented face 41 of jaw member 22 proximate to the first end region 36 in the manner depicted in FIG. 2.

Figure 13:
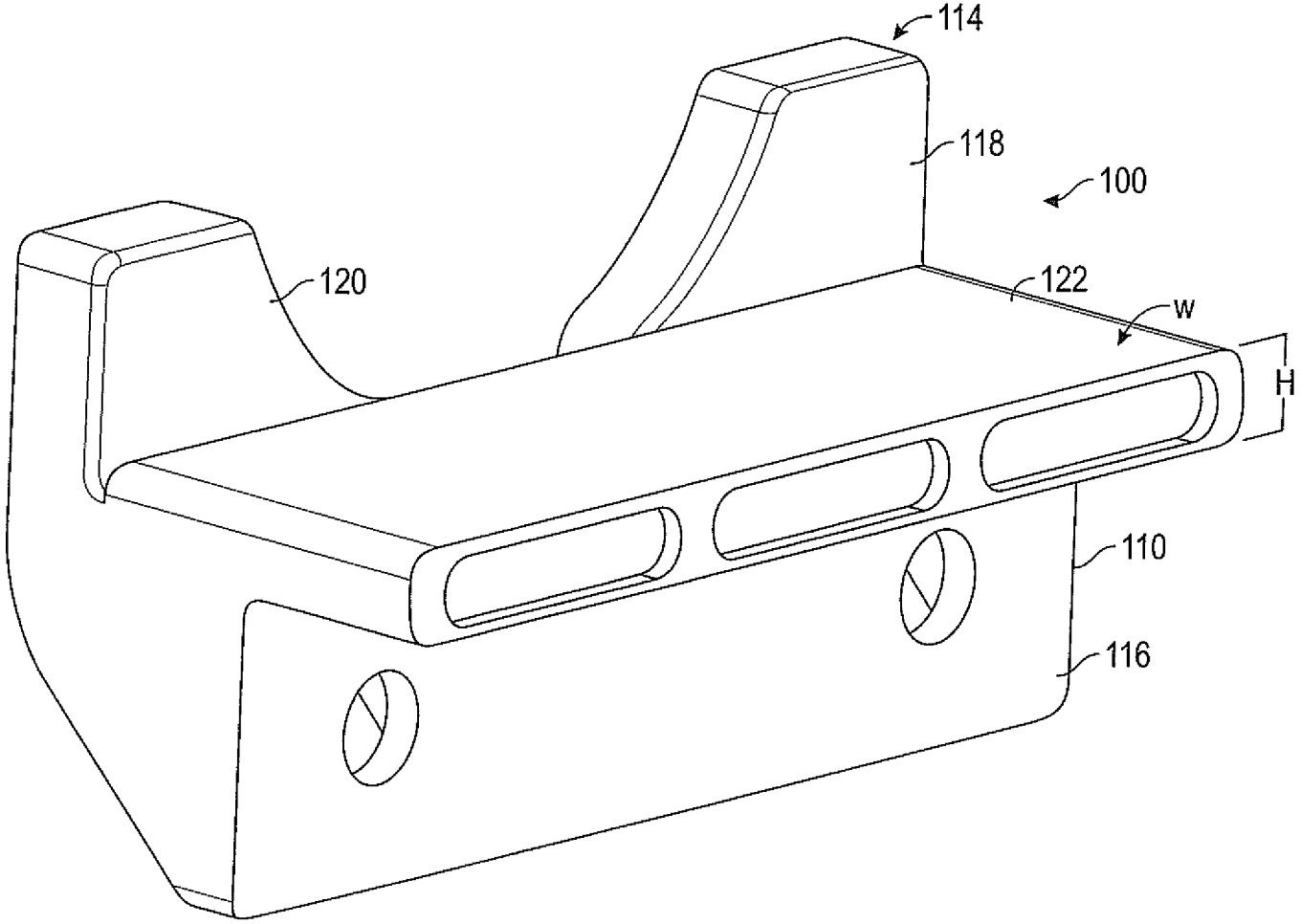
FIG. 13 is a lower view of the fastening mechanism of FIG. 12.
Figure 14:
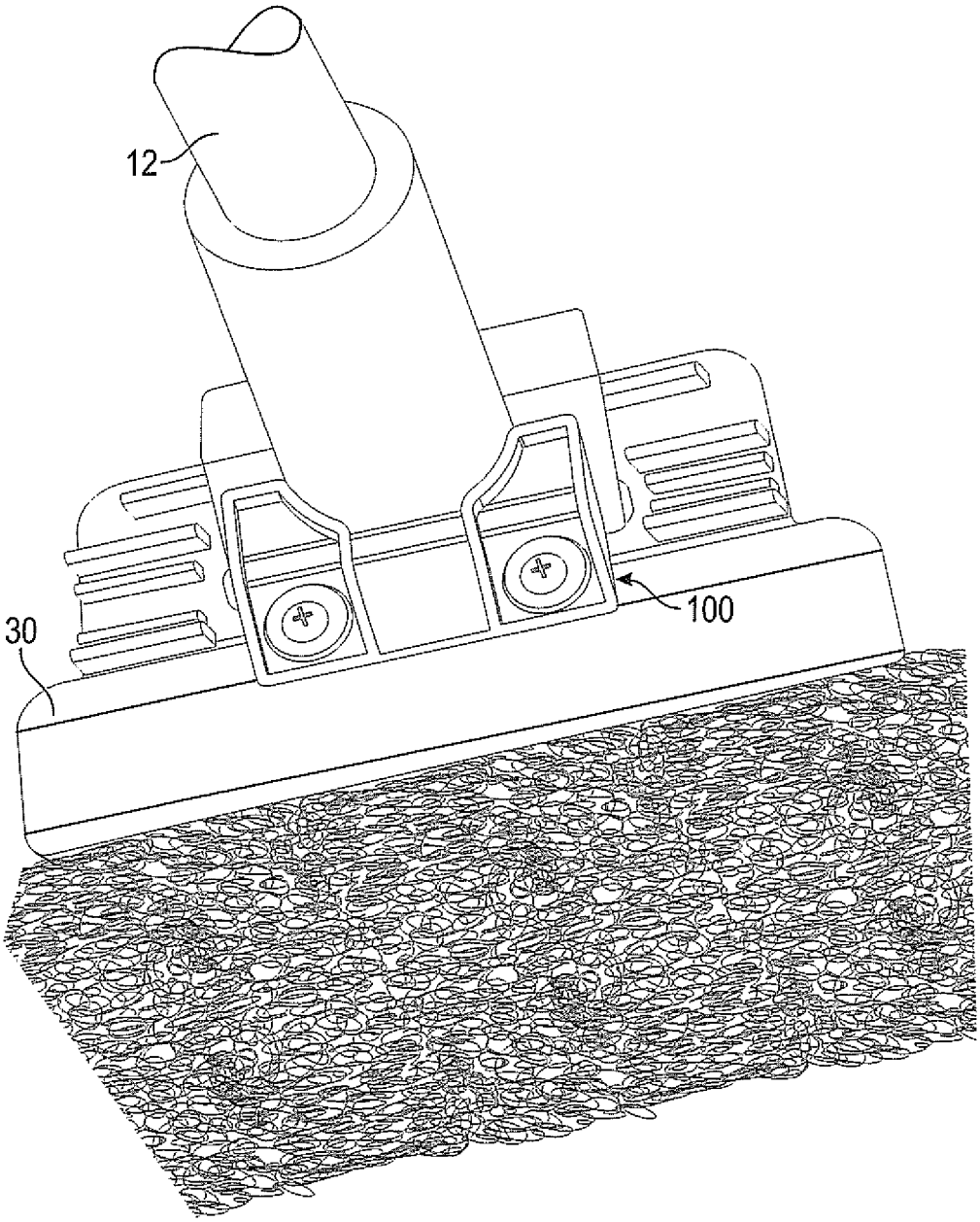
FIG. 14 is a side view of the apparatus of FIG. 12.
Figure 15:
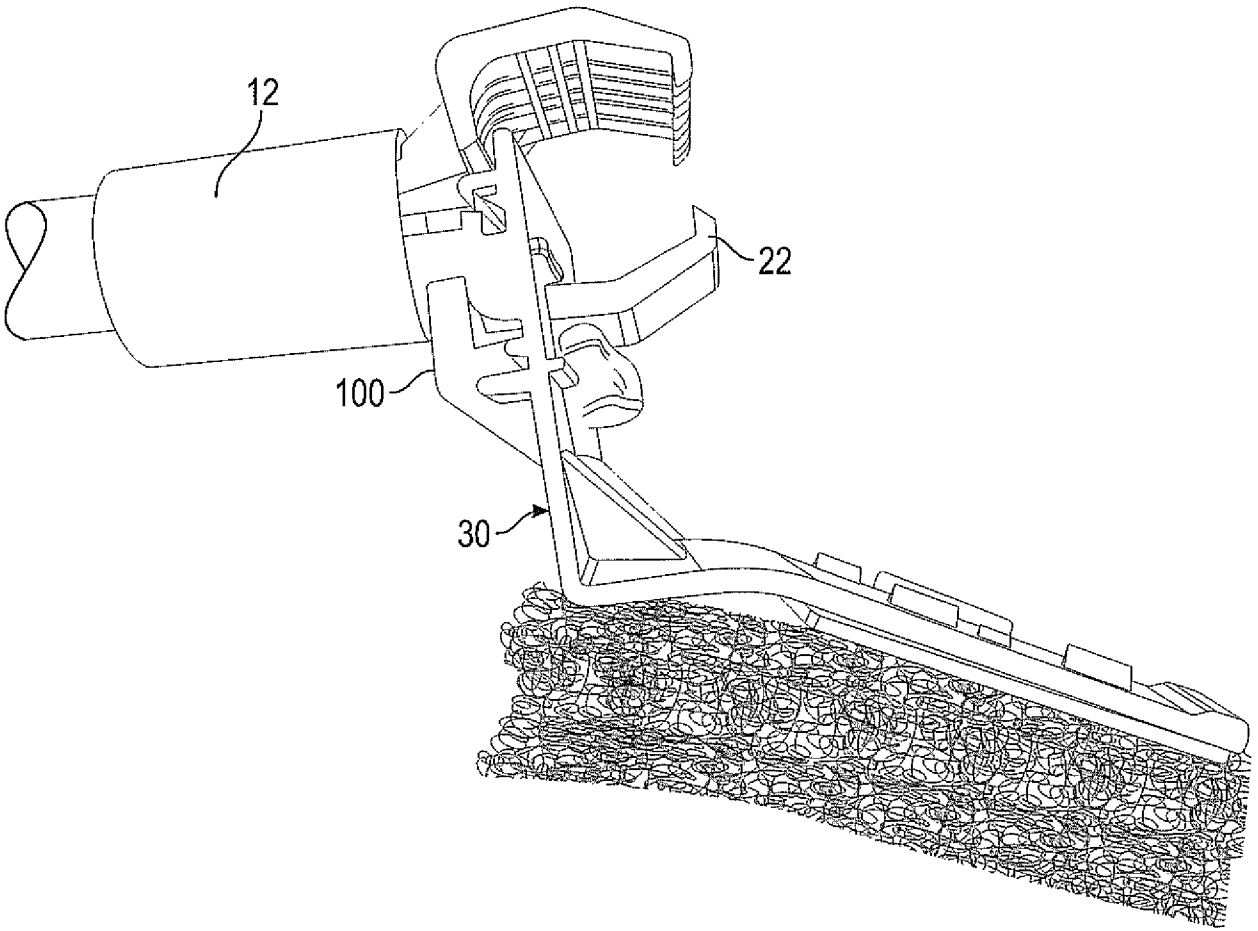
FIG. 15 is an alternate side view of an embodiment of the apparatus of FIG. 14 with jaw member pivotally closed.
Figure 16:
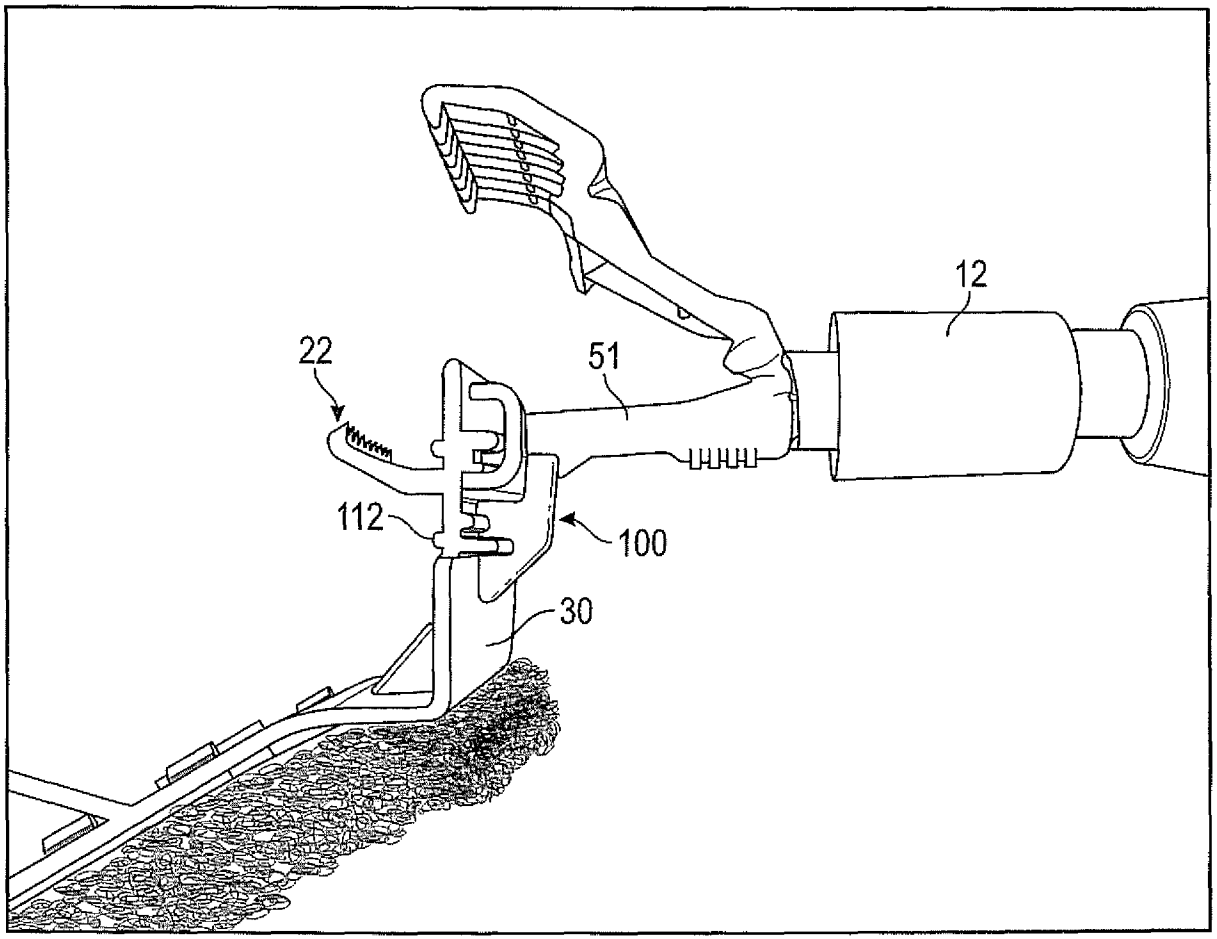
FIG. 16 is an alternate side view of an embodiment of the apparatus of FIG. 14 with the jaw member pivotally opened.
Figure 17:
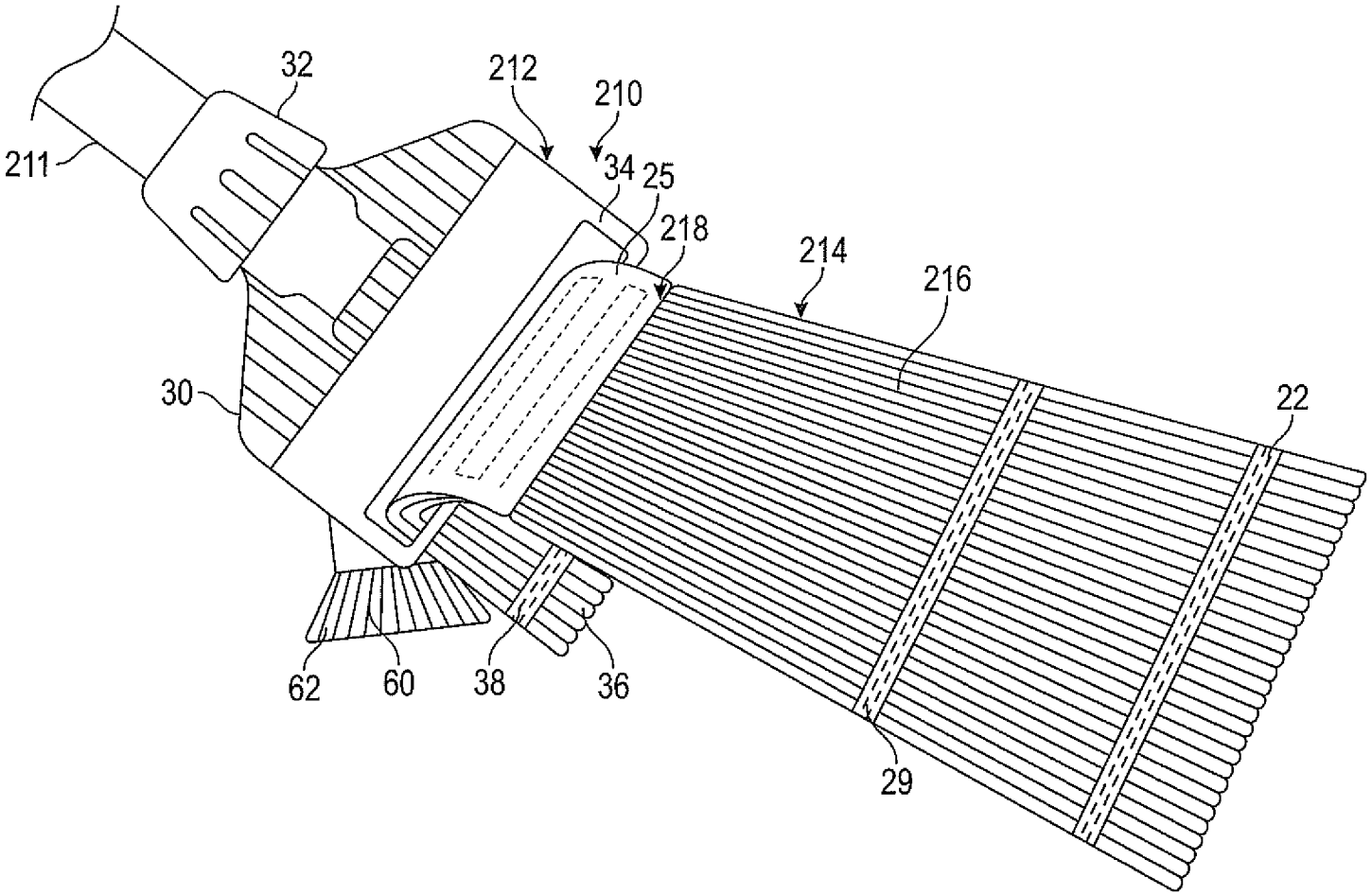
FIG. 17 is a detail perspective view of an embodiment of a mop unit that includes an embodiment of the mop device of the present invention.
Figure 18:
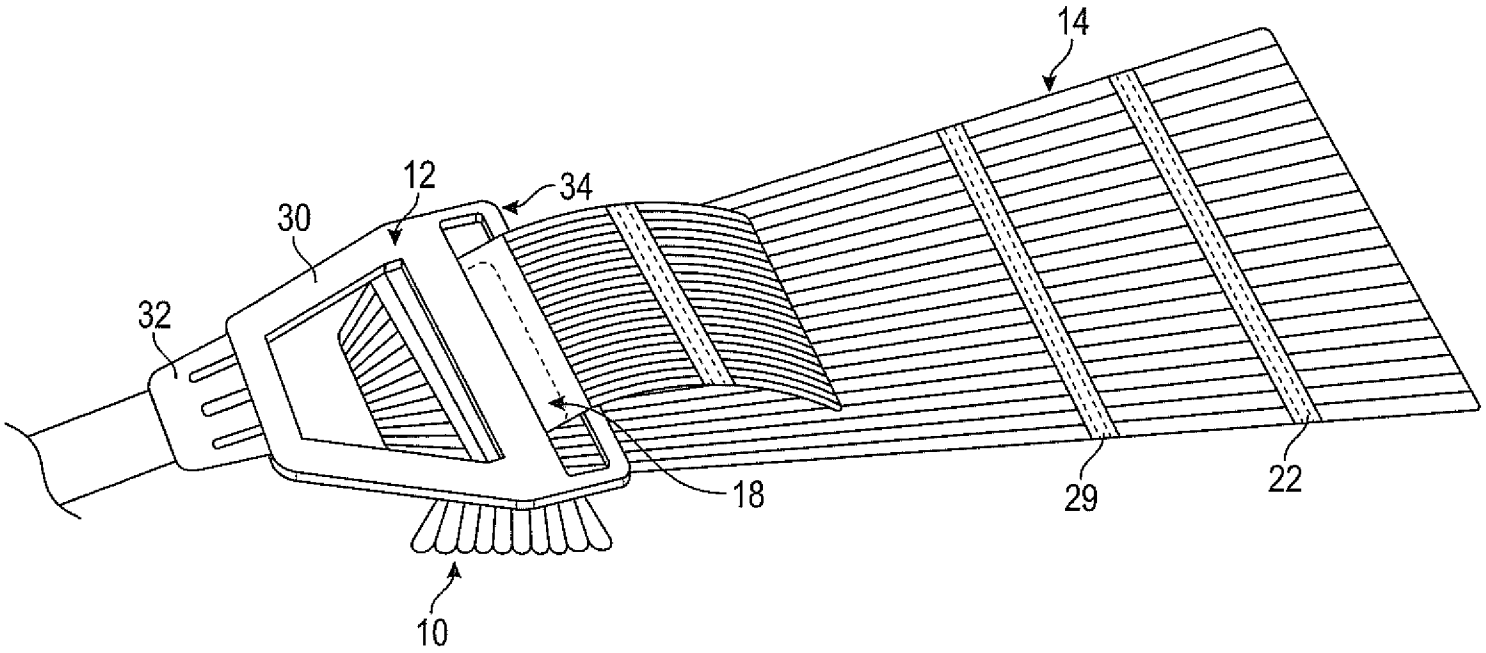
FIG. 18 a detail perspective view of the device of FIG. 17.
Figure 20:
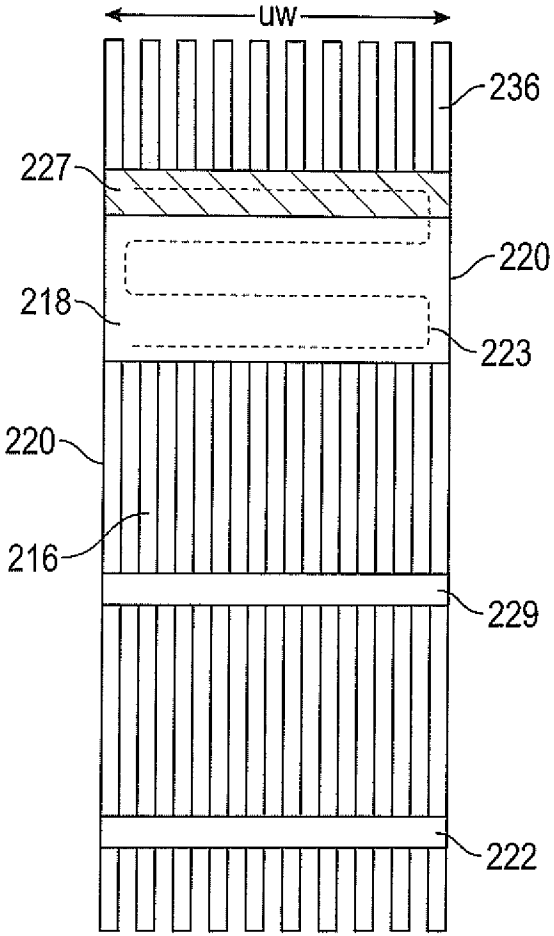
FIGS. 19-20 are plan views of alternate embodiments of a strand bundle that can be employed with various embodiments of the mop device of the present invention.
Figure 19:
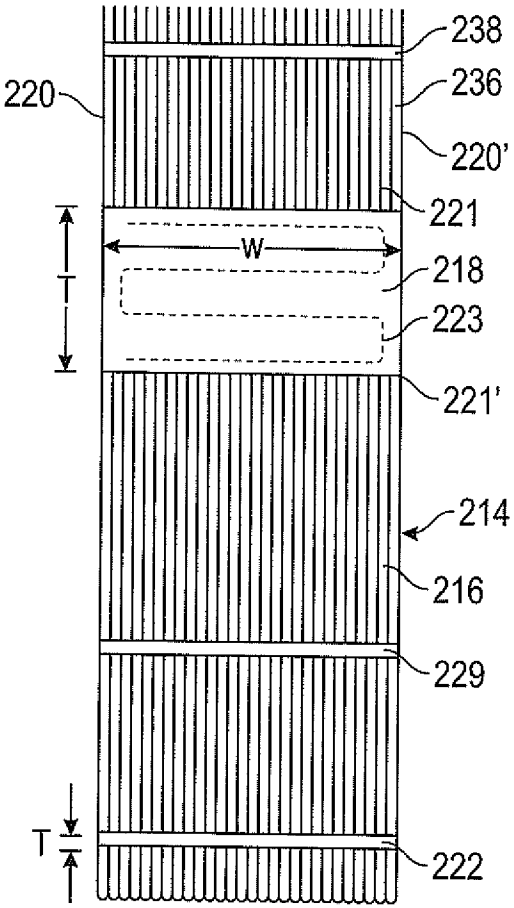
Figure 21:
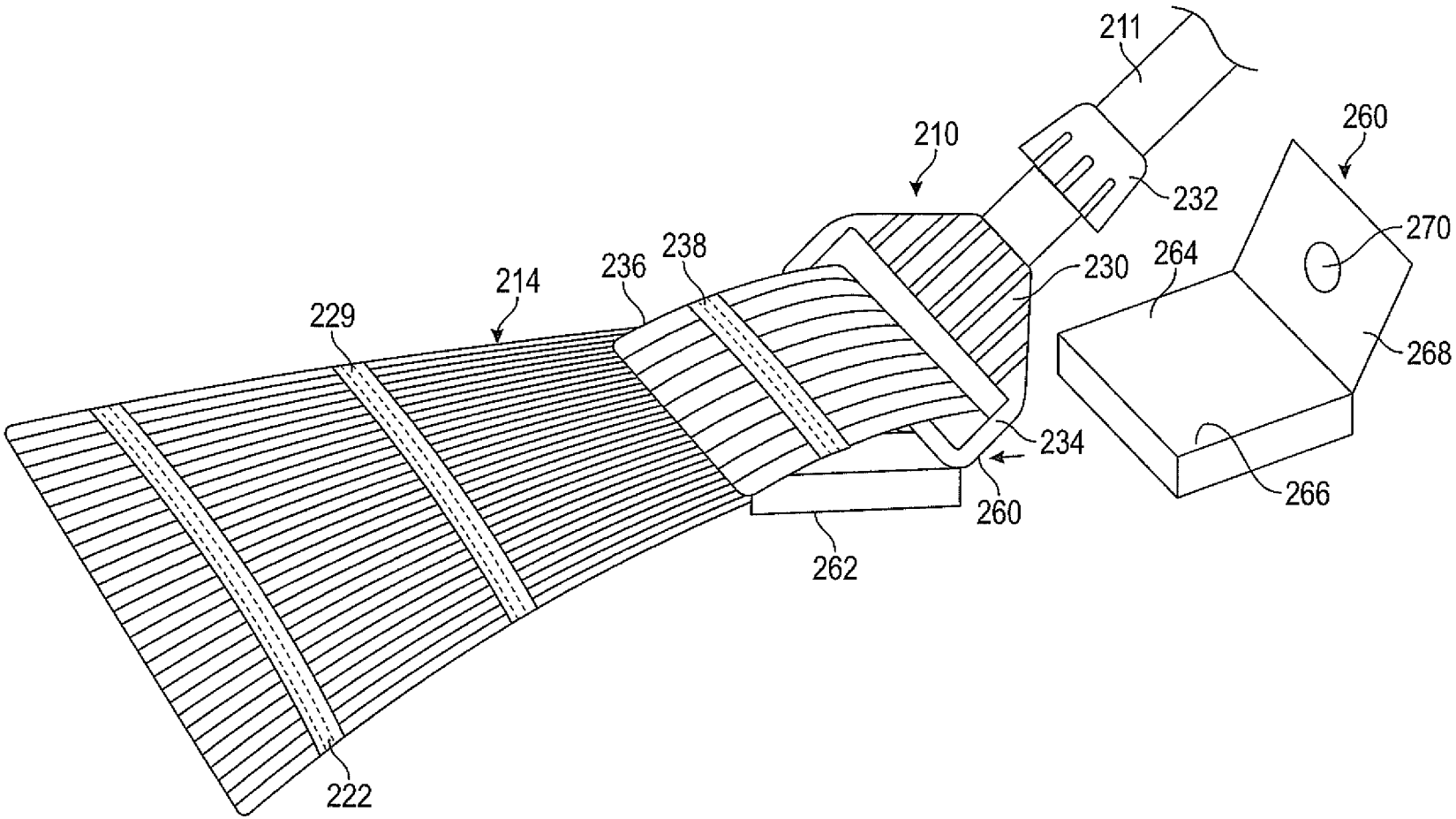
FIG. 21 is a detail perspective view of a mop unit that includes an embodiment of the mop device of the present invention.
Figure 22:
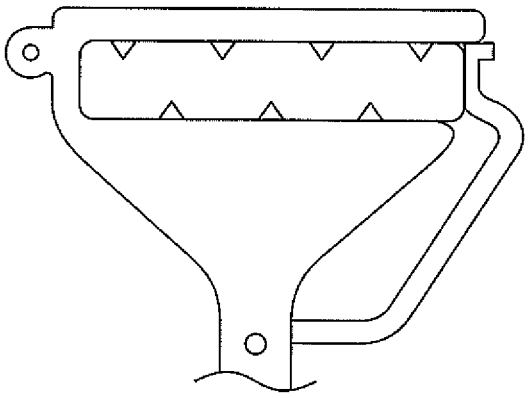
FIG. 22 is an alternate embodiment of a mop handle connection member portion of the mop device as disclosed herein.
Figure 23:
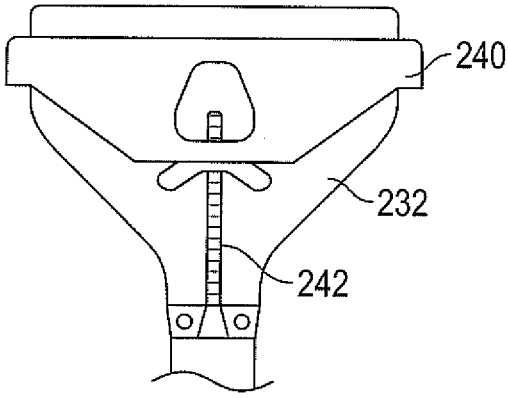
FIG. 23 is an alternate embodiment of a mop handle connection member as disclosed herein depicting a screw clamp configuration.
Figure 24A:
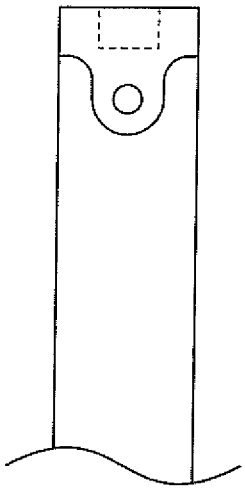
FIGS. 24A and 24B is an alternate embodiment of a mop head as disclosed herein depicting a screw type configuration.
Figure 24B:
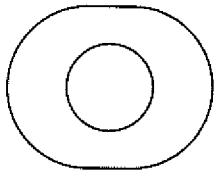
Figure 25:
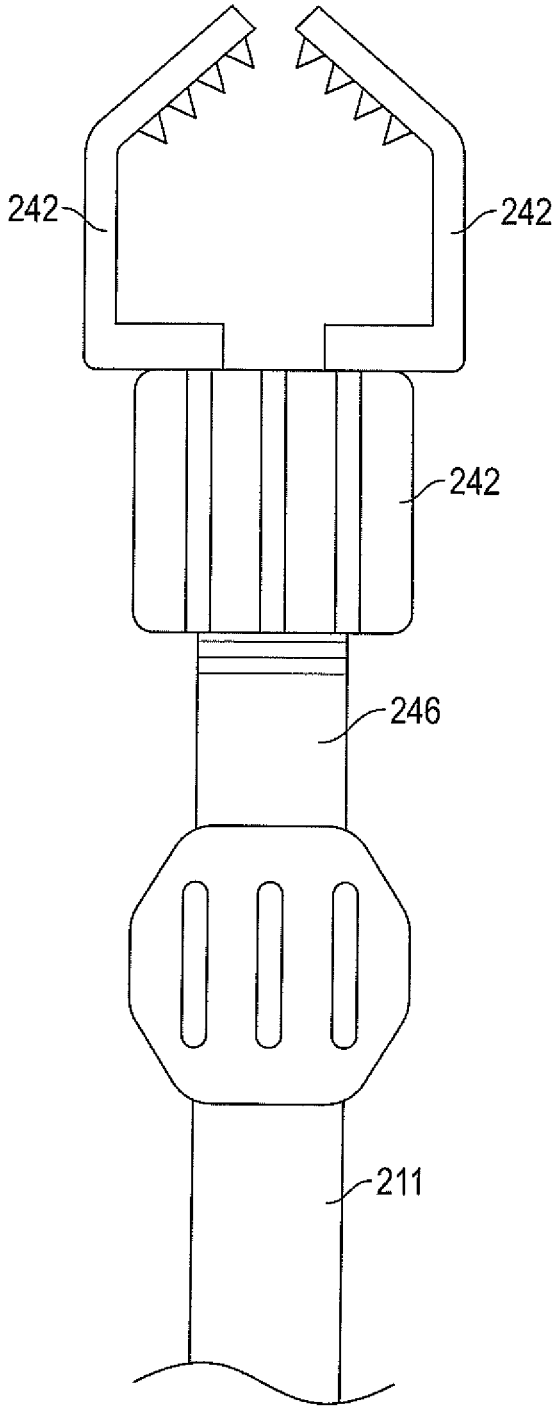
FIG. 25 is an embodiment of a jaw type connection member mop head as disclosed herein.
Figure 26:
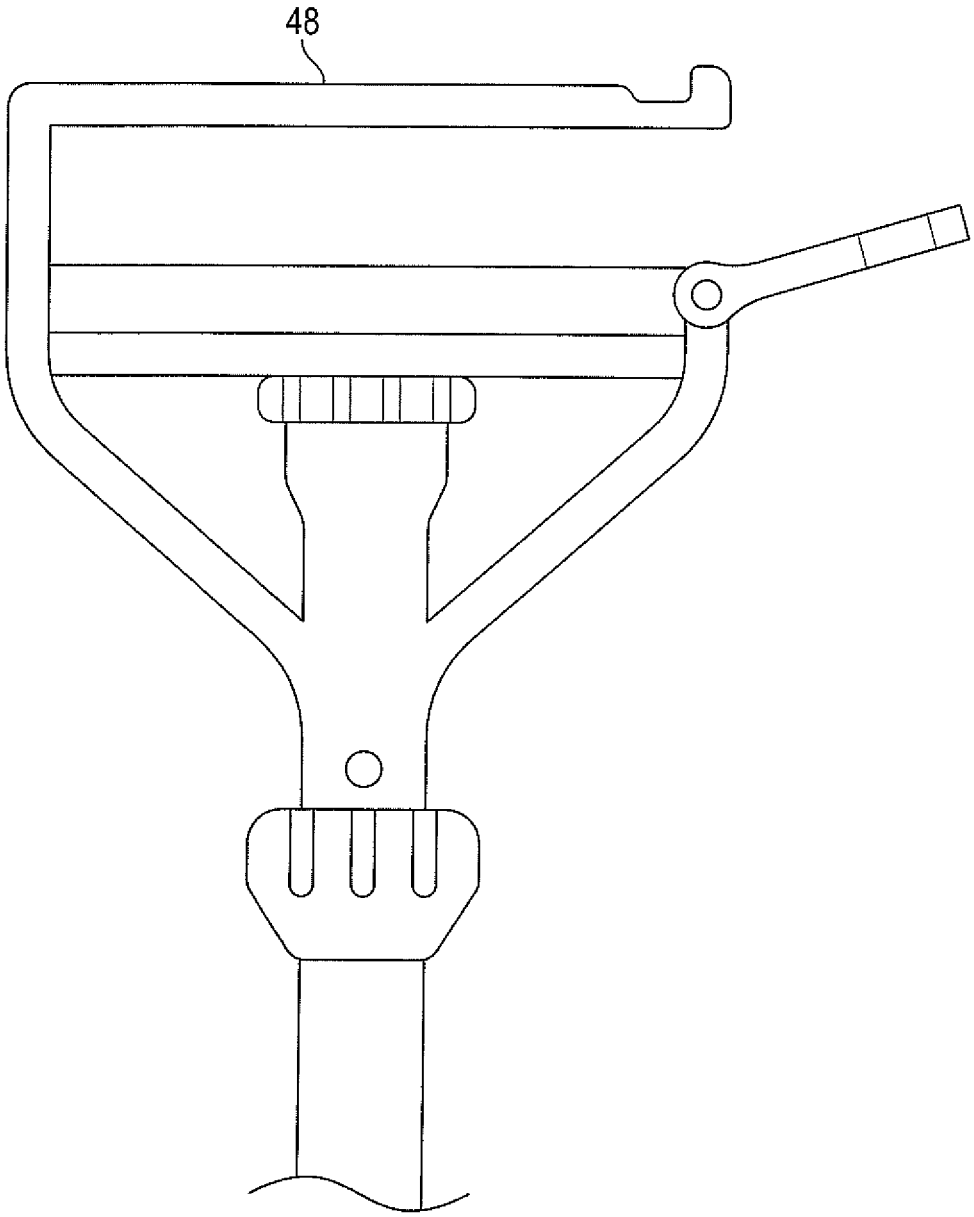
FIG. 26 is an alternate embodiment of a mop head as disclosed herein depicting a side load configuration.
Figure 27:
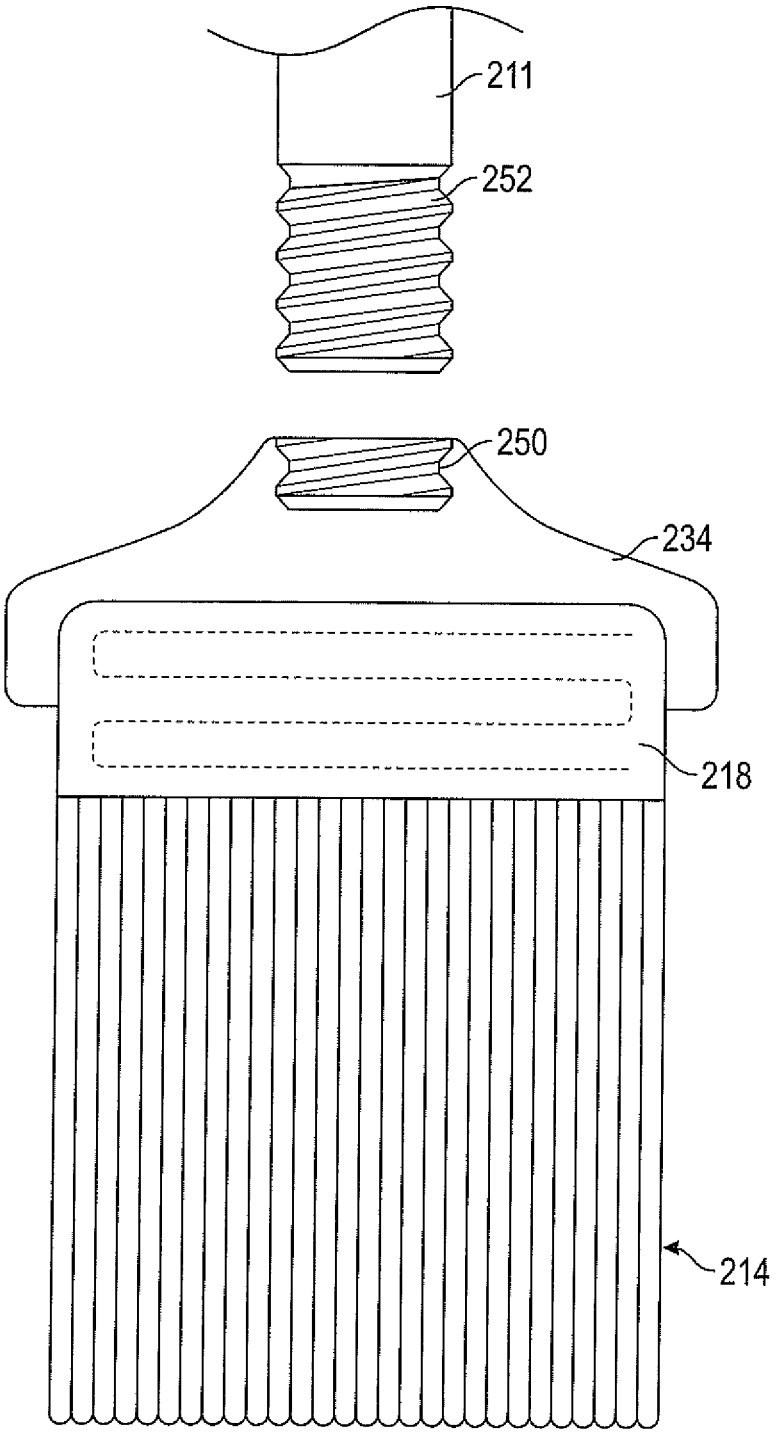
FIG. 27 is an alternate embodiment of a mop head as disclosed herein depicting a plastic screw top mop connector configuration.
Figure 28:
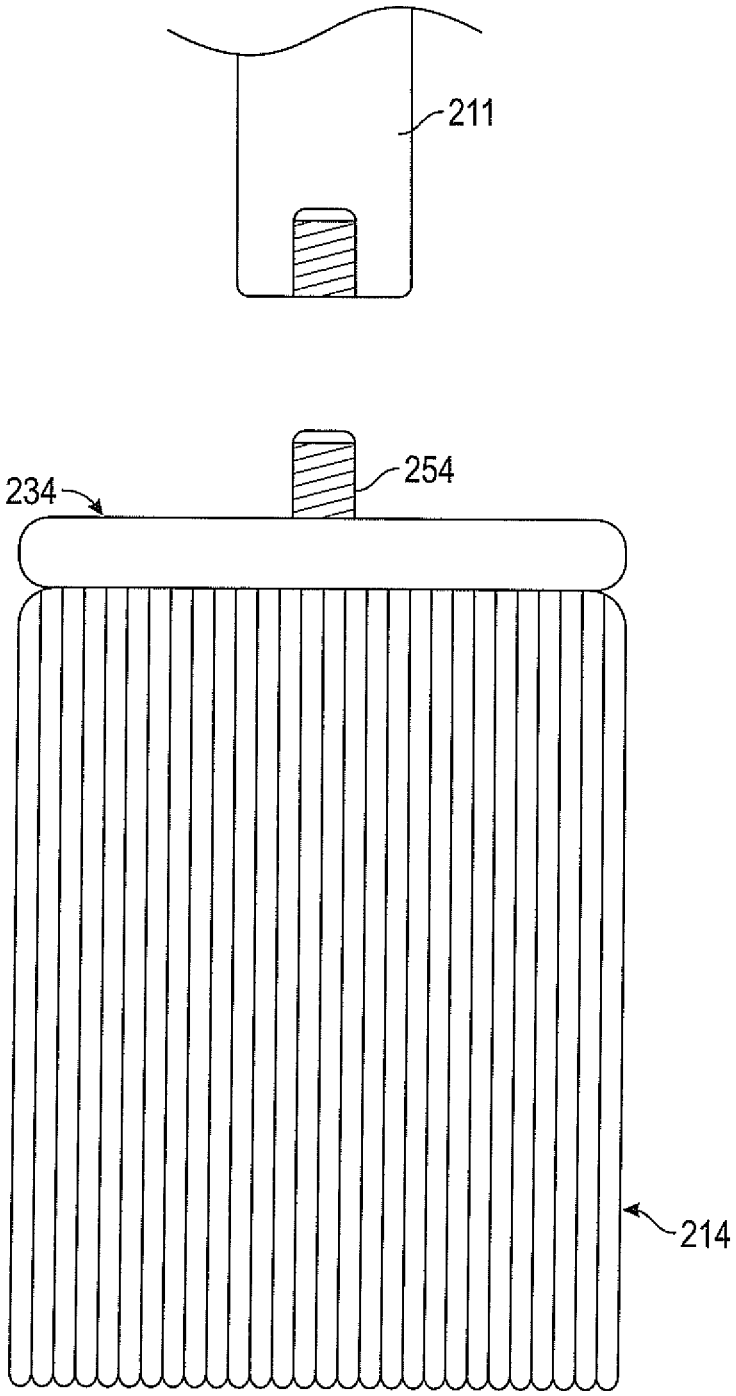
FIG. 28 is an alternate embodiment of a mop head as disclosed herein depicting a threaded connector configuration.

One non-limiting example of the fastening block 100 is depicted in FIG. 13. The fastening block 100 has a central body 110 having a cantilevered protrusion 112 projecting outward therefrom. The cantilevered protrusion 112 has a lateral width W sufficient to be received on aperture 34 defined in mop appliance 30 when mop appliance 30 is operatively connected to the associated mop as depicted in FIGS. 14, 15 and 16. The central body 110 of fastening block 100 can include a lower member 114 having a planar face 116 in contact with a mating face of the mop appliance 30. The fastening block 100 can also have an opposed member 118 that is configured to contact the jaw member 22 at a location suitable to brace the apparatus. In the embodiment depicted in FIGS. 14, 15 and 16, the opposed member 118 has an arcuate face 120 that is configured to engage the arm 52 projecting outward form the jaw member 22. As depicted, the fastening block 100 is a separate member that can be connected to the associated mop appliance device 30 to facilitate maintaining the two elements in secure clamped relationship.

The mop strand bundle 24 as employed herein can have a suitable ergonomical configuration. The strand members can be made of any suitable material. Typically the materials of choice will possess suitable water absorbency. Non-limiting examples of materials include various yarns, cloth tabs and the like. The strand members can be bundled together by suitable bundling means. In various embodiments such as those disclosed herein, the various yarns are stitched together such that the various yarns are positioned in side-by-side with stitching extending in generally crosswise relationship over the various yarns. The stitching can be employed in addition to the headband 218 and/or can be integral the attachment of the headband.

Strands, when in position in the mop strand bundle 24, can be layered relative to one another and can have lengths and widths as the mop strand bundle 24 and associated mop is typically manufactured and sold by weight designation. Provisions for specific lengths and widths are assumed to be flexible and can vary based on yarn diameter and weight. The mop strand bundle 24 that is employed also include a headband 218 connected to the strand members at a point proximate to the fixed location, such that the headband 218 is positioned at a location other than medial to the string members.

The mop strand bundle 24 can be composed of looped-end strands; however a cut-end version of the mop strand bundle 24 is also contemplated in this disclosure. A conventionally designed string looped-end mop or cut-end mop portion is recognized as a mop element formed from a plurality of yarns with a headband 26 and tailband. The string bundle employed in the embodiment disclosed herein may have an offsetting headband 26 location that is not centered on the strands. This allows for more surface area of the mop to be used on the floor while reducing the overall weight of the mop.

As shown in FIGS. 17-21, a suitable wet mop device 210 also described in this disclosure can be composed of a handle 211 connected to a suitable mop head 212. Connection between the handle 211 and the mop head 212 can either be permanent or detachable. It is contemplated that the handle 211 can be composed of suitable metal, plastic or wood as desired or required.

The mop head 212 can be composed of a suitable material such as plastic or metal material. The mop head 212 will be configured to engage a strand bundle 214. Various configurations of the mop head 212 are outlined in this disclosure. In various embodiments depicted, the mop head 212 is configured to releasably contact and engage the strand bundle 214. While releasable engagement is depicted in the various drawing figures, it is contemplated that the wet mop device 210 disclosed herein can have the strand bundle 214 permanently attached to the handle 211 by means of the associated mop head 212.

In the use configuration, the mop head 212 is connected to a suitable strand bundle 214. The handle 211 can be of any suitable configuration. As broadly construed the mop head 212 can also have any suitable configuration. In various embodiments depicted herein the mop head 212 can be configured to be releasably attached to the handle 211. Connection can be by any suitable attachment means including, but not limited to, mating threaded screws, clamps and the like. It is also within the purview of this disclosure that the mop head 212 will be integrally formed the handle 211 as desired or required. The mop portion or strand bundle 214 is composed of a plurality of individual elongated yarns or strands 216 that are oriented lengthwise in an essentially parallel orientation.

The individual yarns or strands 216 may be positioned in a plurality of layers in various embodiments in order to provide thickness and enhance utility of the strand bundle 214. Thus multiple layers of yarns positioned side by side can be integrated in to a strand bundle 214. The individual yarns or strands 216 can be attached to each other to form a unit by employing suitable attachment mechanisms. In various embodiments the yarns or strands 216 can be stitched to one another to form an attachment means that is essentially perpendicular to the orientation of the elongated individual yarns or strands 216. Non-limiting examples of attachment means include direct stitching (not shown) and/or connection or affixing of a suitable headband 218. Where desired or required, the strand bundle 214 can employ both.

In the embodiments depicted, the wet mop device 210 includes a headband 218. The headband 218 can be of any suitable band width, unit width and thickness. Band width W of headband 218 is measured along a plane generally perpendicular to that length of the strand bundle 214 defined by the longitudinal plane coplanar with the elongated yarns or strands 216 when the yarns or strands 216 are oriented in their parallel elongated positions. Unit width UW of the strand bundle 214 is defined as the width of the headband 218 as extending from side end 220 to side end 220 of the strand bundle 214. Thickness T is the measurement of the headband 218 material from interior side edge 221 to opposed side edge 221' The band width W of the headband 218 will be that value sufficient to provide that strand coverage at a desired wet weight. In various embodiments, the headband 218 has a bandwidth W can vary from less than 1" to 8" or greater. The thickness T of headband 218 can be any value that provides sufficient contact surface as will be described in greater detail subsequently. In certain embodiments, the thickness T of headband 218 can be equal to the width W. In other embodiments, it is contemplated that the thickness T will be within 50% of the value of headband width W.

The headband 218 can be composed of various materials. However the primary material will be a 100% polyester material that has been sized for increased stiffness and strength. Non-limiting examples of suitable material include the various polymeric open-weave mesh material that can provide flexibility and conform to the surface of the strand fibers of yarns or strands 216. The headband material is present in overlying relationship to the strand fibers of yarns or strands 216. It can be maintained in position relative to the strand fibers by any suitable attachment mechanism or means. While other attachment means and mechanisms are considered to be within the purview of this disclosure, it is contemplated that the attachment can be by suitable over-stitching 223 that extends form an upper surface 25 to a lower surface (not shown). In the embodiment depicted, the over-stitching 223 is present in a serpentine pattern with the various individual rows of over-stitching 223 progressing transversely from side 220 to opposed side 220'.

The headband 218 can also include a suitable edge marker 227. The edge marker 227 can be integral to the headband 218 material or can be added as a separate member. In certain embodiments, it is contemplated that the edge marker 227 will be a suitable tape or ribbon that is joined to the headband 218 and associated strand bundle 214. The edge marker 227 can be composed of a material of a contrasting color or have other visible indicia means incorporated thereon. The edge marker 227 can provide the operator with the visible orientation mechanisms as desired or required. It is within the purview of this disclosure to include other headband indicia as desired or required. Non-limiting examples would include brand marking, orientation instructions and the like.

Where desired or required, the strand bundle 214 can include additional body bands such as tail band 222. Tail band 222 can be placed proximate to an outer edge of the strand bundle 214. The tail band 222 will generally have a thickness T that is less than the thickness T of the headband 218. The width W of tail band 222 will typically be equal to or greater than the width if the headband 218. In certain embodiments, the tail band 222 has a width W equal to or slightly greater than the width W of headband 218. In certain embodiments, it is also contemplated that the width W of tail band 222 can be up to four times greater than the width of headband 218, with widths between 2W and 3W being suitable in some applications. In certain embodiments, it is contemplated that the tail band 222 can have a width sufficient to permit the flexure of the individual yarns or strands 216. In certain applications, it is contemplated that the width of the tail band can be less than the width of the headband to accommodate stand flexure.

The tail band 222 can be made from various blends of materials; however the preferred material will be 100% polyester material. The tail band 222 can be attached to the strand bundle 214 by any suitable means or mechanism. In various embodiments, the tail band 222 is attached to the strand bundle 214 by suitable stitching that passes through the upper surface of the tail and travelling through the various yarns or strands 216 in the strand bundle 214 to hold the yarns securely in place. The various yarns or strands 216 are typically engaged in an edge-to-edge fashion. The strand bundle 214 of wet mop device 210 such as may also include a single or double tail band 222. The tail band 222 can be made from various blends of materials; however the preferred material will be a 100% polyester material. In certain embodiments, the strand bundle 214 may include an intermediate band 229 located at a spaced distance between the headband 218 and the tail band 222. Intermediate band 229 can have a width W equal to width W of the headband 218 and the tail band 222. The tail band 222 and the intermediate band 229 can be positioned on the strand bundle 214 at locations that will provide and permit movement of the individual yarns or strands 216 relative to one another. In various embodiments, the tail band 222 will be located proximate to an edge region of the strand bundle 214. The location will be such that a fringe of either looped strands or cut strands that extend outward from the tail bands 222. The intermediate band 229 will typically be located at a position medial between the headband 218 and the tail band 222 such that the associated strand bundle 214 can flex and move relative to the associated mop head 212.

The strand bundle 214 of the wet mop device 210 as disclosed herein can be composed of any suitable absorbent material configured as woven strands, yarn material and the like. The materials of choice will be absorbent, wringable and may be capable of reuse. Thus the yarn or strand material 216 (as well as any headband material) can be washable by suitable industrial washing techniques. Some examples of suitable material include but are not limited to yarn materials such as 100% cotton, various cotton/synthetic blend mixes, 100% synthetic blend, 100% microfiber or a microfiber blend yarn material. It is contemplated that in applications where the yarn or strand material 216 of strand bundle 214 is washable and reusable, the materials employed in the tail band 222, intermediate band 229 and headband 218 will also be reusable and washable.

It is also contemplated that the wet mop device 210 can be composed of one or more components that are biodegradable. In certain embodiments, it is contemplated that devices such as those disclosed herein will be designed such that each individual component which makes up the strand bundle 214 of the wet mop device 210 is determined to be biodegradable when processed in a composting environment. Biodegradable components can include headband material that is biodegradable when placed in composting environment. The tail band 222 and/or intermediate band 229 also can employ a material that is biodegradable when placed in a composting environment. The thread material used for stitch-fastening the strand bundle 214 can also be biodegradable material when placed in a composting environment. It is also contemplated that any printed labels associated with the strand bundle 214 to provide part number or private label information can employ earth-friendly inks printed onto a label material that will dissolve when placed in a chemical or in a compositing environment. The yarn material is a specially blended yarn material where the fibers of the yarn material will breakdown in a composting environment.

In various embodiments depicted, the tail band 222 and intermediate band 229 are disclosed to be straight cross-sectional members. It is also within the purview of this disclosure that one or more of the tail band 222 and/or intermediate band 229 can be configured in an X configuration as well as V and W configurations if desired or required. While stitch bonding is discussed in conjunction with the embodiment disclosed in the various drawing figures, it is also contemplated that one or more of the bands can be glued or heat-bonded to achieve attachment.

The strand bundle 214 is configured such that the headband 218 is located proximate to one of the collected yarns or strands 216. The strand bundle 214 is divided into a larger strand region that can include tail band 222 and intermediate band 229. The strand bundle 214 also includes a region having headband 218 and a smaller fringe region 236 located opposite the larger strand region. The fringe region 236 will have a width equal to or greater than the width W of headband 218 and can be composed of either looped strands or cut strands of the fiber material. Where desired or required, the fringe region 236 can also include a band member 238 attached to and connecting the various individual yarns or strands 216. In situations where the width of the fringe region 236 is greater than the headband 218 region, the various loops of the fringe region 236 can form a fluted or pleated configuration relative to one another. In such situations, the band member 238 can assist in maintaining the fluting undulation in the fringe region 236. The longitudinal thickness of the fringe region 236 will be equal to or less than the thickness T of the associated headband 218 in certain embodiments.

The unique design of the wet mop device 210 as disclosed herein has been found to allow for more contact points between the yarn material of the strand bundle 214 and the floor surface area to be cleaned. The increased contact points allow for more fluid absorption and/or release. The result can be more fluid absorbed from the floor surface and/or chemical fluids to be released onto the floor surface to improve cleanability and/or soil load pick-up. This unique design also reduces manual labor time as the operator would not be required to return to the bucket and wringer as frequently as would be required to return to an associated bucket and wringer containing water and/or cleaning chemicals as frequently as would be required with a conventional mop of standard conventional industry design of the same weight, The strand bundle 214 can be employed with the mop head 212 as disclosed herein. The headband can be folded such that the shorter or fringe end will be proximate to the mop appliance 30. In embodiments where the mop appliance has a scrubbing member 270 such as a pad, the shorter fringe region 236 will provide additional weight to weight down the scrubbing member 270 to enhance the scrubbing action of the member. The scrubbing member 270 can be configured with a suitable agitation surface that includes at least one region of abrasion configured to engage and remove surface dirt adhering to the floor. In various embodiments, the agitation surface can be provided as a brush, pad, sponge or the like. The scrubbing member 270 can be affixed to the mop appliance 30 in either a permanent or releasable relationship. The mop appliance 30 can have a suitable member pivotally attached to the body 32 and extending angularly outward therefrom.

The mop head 212 can be configured to releasably position the mop strand bundle 214 in an operative position relative to the handle 211. Mop head 212 will include a suitable body 230 having means 232 for connecting the mop head 212 to the handle 211. A non-limiting example of such connection means 232 is mating threaded surfaces on the end of handle 211 configured to be received in a suitably mating orifice defined in the mop head body.

The body 230 of mop head 212 also includes suitable means 234 for releasably positioning the strand bundle 214 in the mop head 212. In the various embodiments, the strand bundle 214 connecting means can be configured as a suitable clasp or the like. Various connection mechanisms are presented in the various drawing figures. It is also considered to be within the purview of this present disclosure that the strand bundle 214 be permanently mounted relative to the mop head 212.

The mop head 212 is also configured with at least one scrubbing member 270 that is oriented proximate to the strand bundle 214. The scrubbing member 270 can be configured as a brush, pad sponge or the like that can be affixed to the mop head 212 in either permanent or releasable relationship. The scrubbing member 270 is mounted to the mop head 212 at a location distal to the handle member connection point such that pressure exerted on the handle 211 is transferred to the scrubbing member 270 when desired.

In the in-use scrubbing position, the strand bundle 214 overlies the scrubbing member 270 and can trail behind it as depicted in the various drawing figures. This provides continual downward pressure on the scrubbing member 270 enhancing cleaning action. The strand bundle 214 is oriented such that the shorter portion of the threaded bundle rests on overlying relationship relative to the scrubbing member 270 providing localized weight and continued downward pressure without the extensive additional weight for the unit.

The orientation of headband 218 relative to the strand bundle 214 permits the mop yarn material to come into contact with the cleaning surface in a more efficient manner than conventional mop stand bundles; permitting more efficient use in either looped or cut style yarns or strands.

The short fringe area 236 opposed to the longer cleaning looped-end side can function as a protection buffer from the connecting hardware assisting in minimizing contact of the by the hardware with the cleaning surface. The short looped fringe area 236 acts as a buffer between the two elements—namely the appliance and the mop handle connection member 12 as well as certain types of cleaning hardware. The short looped fringe are also prevents individual mop yarns or strands 216 from becoming entangles underneath the scrubbing member 270 when mopping. It has also been discovered that the orientation of the scrubbing member 270 relative to the short fringe area 236 and the longer region of the strand bundle 214 produces a wet mop configuration that can be moved across the floor surface with enhanced ease and increased effectiveness. It is believed that the scrubbing surface of the scrubbing member 270 produces a lubricious movement effect such that the scrubbing member 270 slides across the floor surface in an upwardly oriented manner during mopping operations and engages the floor surface when required to dislodge material that can be readily picked up by the associated mop yarns or strands 216. The trailing orientation of the mops strand bundle 214, when in use in the scrubbing mode permits increased opportunity to collect debris, dirt and cleaning material dislodged by the scrubbing member 270. The scrubbing member 270 can have any suitable size and/or dimension. In certain embodiments, the scrubbing member 270 can be configured to have a width essentially equal to the width of the headband 218.

The mop device 10 as disclosed herein is intended to be used for floor cleaning operations involving various aqueous and non-aqueous cleaning compounds alone or in combination with floor treatment materials such as sanitizers, disinfectants and cleaners. The materials can be those having a suitable pH with materials having acidic based compositions—pH between 0 and 7—being used for certain floor clearing chemical compounds and alkaline compositions—having pH levels between 7 and 14 being used for caustic floor cleaners.

The wet mop configuration with mop strand bundle 214 as disclosed herein, can permit larger floor finish operations while using a lighter weight mop strand bundle. Additionally the mop strand bundle 214 combined with a mop appliance 30 can be employed to achieve ergonomic cleaning operations. The mop strand bundle 214 in combination with the mop device 10 as disclosed herein, can be used with a variety of wringer/bucket combinations. The configuration disclosed herein requires less effort to place the mop device 10 in a wringer for solid/fluid release when depressed by the wringer lever. It is also easier to remove once the soil and fluid are released.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A mop device comprising:

a mop handle connection member, the mop handle connection member having a central body having a first end and an opposed second end, the connection member having:

means for engaging a mop handle member, the engaging means associated with the first end of the central body; and at least one jaw member associated with the second end of the central body, the jaw member configured to releasably connect with a mop strand bundle, wherein the at least one jaw member has a first end proximate to the central body of the mop connection member, an opposed second end distal to the first end, and a central arm region contiguously located therebetween, the central region of the at least one jaw member further having a strand bundle face and an opposed outwardly oriented face, the jaw member having a flange projecting outward from the outwardly oriented surface of the central arm region and at least one detent defined in the outwardly oriented surface of the central arm region, the detent defined in the outwardly oriented surface of the central arm region in spaced relationship to the flange;

at least one accessory member connected to the jaw member, the accessory member having a mop attachment region having opposed first and second faces and at least one cleaning region connected to the mop attachment region, wherein the mop attachment region has at least one aperture defined therein, the aperture configured to receive the central arm region of the jaw member therein such that the first face of the mop attachment region contacts the flange of the jaw member and the opposed face of the mop attachment region is engaged by the detent defined in the outwardly oriented surface of the central region of the at least one jaw member.

2. The mop device of claim 1, further comprising a mop strand bundle having a headband and a plurality of individual yarn strands oriented in parallel relationship to one another and connected to one another at at least one location, wherein the head band is in bent overlapping relationship in releasable connection with the opposed second end of the jaw member.

3. The mop device of claim 2, wherein the headband is positioned in offset location between the first and second ends of the mop strand bundle.

4. The mop device of claim 1, wherein the at least one jaw member further comprises at least one living hinge member defined in the central region of the jaw member, the living hinge member having an edge movably projecting outward from the outwardly oriented surface of the jaw member to define the detent in the outwardly oriented surface.

5. The mop device of claim 4 wherein mop attachment region has a first face and an opposed second face and the aperture extends from the first face to the opposed second face of the attachment region, the aperture of the mop attachment region of the accessory member defined by at least one first edge connected to the first and second faces to define a lip, wherein the lip contacts an associated region of the flange, the inner detent surface and the living hinge member.

6. The mop device of claim 1, wherein the at least one jaw member further comprises a ridge defined on the outwardly oriented surface of the jaw member and projecting outward therefrom at an orientation essentially parallel to the flange, the ridge having a planar surface projecting angularly upward from a leading edge distal to the flange and a trailing edge contiguous to a planar wall projecting perpendicular to the outwardly oriented surface, the ridge defining the detent in the outwardly oriented surface.

7. The mop device of claim 6 wherein mop attachment region has a first face and an opposed second face and the aperture extends from the first face to the opposed second face of the attachment region, the aperture of the mop attachment region of the accessory member defined by at least one first edge connected to the first and second faces to define a lip, wherein the lip contacts an associated region of the flange, the inner detent surface and the ridge member.

8. The mop device of claim 1, wherein the at least one jaw member further comprises at least two ribs, the ribs projecting outward from the inwardly oriented face of the at least one jaw member, the ribs extending from a location proximate to the second end of the jaw member to a location proximate two the first end of the jaw member, the ribs having a retention member defined therein at a location proximate to the first end of the jaw member.

9. The mop device of claim 8, wherein the retention member defined in the ribs is parallel and opposed to the detent defined in the outwardly oriented surface of the jaw member.

10. The mop device of claim 1, wherein the flange is defined in parallel abutting relationship to a wall member, the wall member contiguously connected to the first end of the jaw member in abutting relationship to the connector member.

11. The mop device of claim 10 further comprising a fastening block attached to the mop attachment region of the accessory member and the central body of the mop connection member.

12. A mop device comprising:

a mop handle connection member, the mop handle connection member having a central body having a first end and an opposed second end, the connection member having:

means for engaging a mop handle member, the engaging means associated with the first end of the central body; and at least one jaw member associated with the second end of the central body, the jaw member configured to releasably connect with a mop strand bundle, wherein the at least one jaw member has a first end proximate to the central body of the mop connection member, an opposed second end distal to the first end, and a central arm region contiguously located therebetween, the central region of the at least one jaw member further having a strand bundle face and an opposed outwardly oriented face, the jaw member having a flange projecting outward from outwardly oriented surface of the central arm region and at least one detent defined in the outwardly oriented surface of the central arm region, the detent defined in the outwardly oriented surface of the central arm region in spaced relationship to the flange;

at least one accessory member connected to the mop handle connection member, the accessory member having a mop attachment region having opposed first and second faces and at least one cleaning region connected to the mop attachment region, wherein the mop attachment region has at least one aperture defined therein, the aperture configured to receive the central arm region of the jaw member therein such that the first face of the mop attachment region contacts the flange of the jaw member and the opposed face of the mop attachment region is engaged by the detent defined in the outwardly oriented surface of the central region of the at least one jaw member; and wherein the at least one jaw member further comprises at least one stop member defined in the outwardly oriented facing surface of the central arm region, the stop member defining the detent, the stop member including one of the following:

at least one living hinge member defined in the central region of the jaw member, the living hinge member having an edge movably projecting outward from the outwardly oriented surface of the jaw member to define the detent in the outwardly oriented surface;

a ridge defined on the outwardly oriented surface of the jaw member and projecting outward therefrom at an orientation essentially parallel to the flange, the ridge having a planar surface projecting angularly upward from a leading edge distal to the flange and a trailing edge contiguous to a planar wall projecting perpendicular to the outwardly oriented surface, the ridge defining the detent in the outwardly oriented surface.

13. The mop device of claim 12, wherein the at least one jaw member further comprises at least two ribs, the ribs projecting outward from the inwardly oriented face of the at least one jaw member, the ribs extending from a location proximate to the second end of the jaw member to a location proximate two the first end of the jaw member, the ribs having a retention member defined therein at a location proximate to the first end of the jaw member.

14. The mop device of claim 13, wherein the retention member defined in the ribs is parallel and opposed to the detent defined in the outwardly oriented surface of the jaw member.

15. The mop device of claim 12, further comprising a mop strand bundle having a headband and a plurality of individual yarn strands oriented in parallel relationship to one another and connected to one another at at least one location, wherein the head band is in bent overlapping relationship in releasable connection with the opposed second end of the jaw member.

16. The mop device of claim 15, wherein the headband is positioned in offset location between the first and second ends of the mop strand bundle.

17. The mop device of claim 16 wherein the mop strand bundle fuerh comprises at least one tail band.

* * * * *